US007522853B2

(12) United States Patent
Uchitani

(10) Patent No.: US 7,522,853 B2
(45) Date of Patent: Apr. 21, 2009

(54) METHOD AND UNIT OF CONTROLLING APPLIED VOLTAGES FOR UNIFORMLY CHARGING A PHOTORECEPTOR

(75) Inventor: Takeshi Uchitani, Kamakura (JP)

(73) Assignee: Ricoh Company, Ltd., Tokyo (JP)

( * ) Notice: Subject to any disclaimer, the term of this patent is extended or adjusted under 35 U.S.C. 154(b) by 255 days.

(21) Appl. No.: 11/545,486

(22) Filed: Oct. 11, 2006

(65) Prior Publication Data

US 2007/0091657 A1 Apr. 26, 2007

(30) Foreign Application Priority Data

Oct. 19, 2005 (JP) ..... 2005-304472

(51) Int. Cl.
*G03G 15/02* (2006.01)

(52) U.S. Cl. ..... 399/50; 399/111; 399/115

(58) Field of Classification Search ..... 399/38, 399/47, 48, 50, 111, 115
See application file for complete search history.

(56) References Cited

U.S. PATENT DOCUMENTS 6,785,482 B2 * 8/2004 Ogata et al. ..... 399/55
6,829,444 B2 * 12/2004 Ashikawa ..... 399/44
2005/0271420 A1 12/2005 Arai et al.
2006/0115286 A1 6/2006 Uchitani et al.
2007/0091657 A1 4/2007 Uchitani

FOREIGN PATENT DOCUMENTS

JP 2001-109238 4/2001
JP 2002-108059 4/2002

OTHER PUBLICATIONS

U.S. Appl. No. 12/049,838, filed Mar. 17, 2008, Senoh et al.

* cited by examiner

*Primary Examiner*—Hoan H Tran
(74) *Attorney, Agent, or Firm*—Oblon, Spivak, McClelland, Maier & Neustadt, P.C.

(57) ABSTRACT

A method of controlling AC voltages applied to a charging member to bring a photoreceptor to a state of uniform charging, with reduced time required for setting AC voltage value. The method includes the steps of determining a relational expression between AC voltage and AC current flowing into the charge receptor member using a discharge onset voltage Vth, a first detection current flowing into the charge receptor member under a first AC voltage of 2×Vth or larger, a second detection current under a second AC voltage, which is 2×Vth or larger and different from the first AC voltage; and obtaining a third AC voltage by substituting a predetermined standard AC current value into the relational expression. When the third AC current under the third AC voltage, which is actually applied to the charging member, is within a predetermined range, the third AC voltage is set as the AC voltage to be applied to the charging member.

18 Claims, 8 Drawing Sheets

METHOD AND UNIT OF CONTROLLING APPLIED VOLTAGES FOR UNIFORMLY CHARGING A PHOTORECEPTOR

This application claims priority to Japanese application No. 2005-304472, filed on Oct. 19, 2005, the entire contents of which are hereby incorporated by reference.

FIELD OF INVENTION

The invention relates to methods and units of controlling voltages applied to a charging member, and more particularly to a method of controlling AC voltages applied to the charging member for uniformly charging a photoreceptor with reduced time required for setting AC voltage value. Also related are a charging unit for implementing the method, and a process cartridge and an image forming apparatus incorporating the charging unit.

BACKGROUND OF INVENTION

The process of electrophotographic image formation is well known and useful for both analog and digital copying and other reproduction techniques. Generally, the electrophotographic reproduction process is initiated by attaining substantially uniform charging with electricity of a photoreceptive member, and an electrophotographic image forming apparatus is provided with a charging unit for performing the charging.

As a method of the charging, the proximity charging method is cited, in which the charging the surface of photoreceptive member is carried out utilizing proximity discharge induced by the photoreceptive member and a charging member provided opposing thereto.

The proximity discharge is generated in a minute gap in discharge region formed between the photoreceptor surface and the charging member, which are placed either in direct contact with, or in close vicinity to, each other. In the former case of direct contact, some of the region surrounding the contacted portion functions as minute gaps for generating the discharge.

By means of the discharge generated in the minute gap region, the surface of photoreceptive member is charged with electricity.

In the charging method utilizing the proximity discharge, it is known from experimentation that the amount of discharge sufficient for uniformly charging the photoreceptor can be obtained by applying to a charging roller (1) first, solely DC voltage and (2) AC voltage (peak-to-peak) of 2×Vth, in which the value Vth is defined as the discharge onset voltage or the voltage value for initiating a discharge to the photoreceptive member (Japanese Laid-Open Patent Application No. 2001-109238, for example).

It should be noted that the voltage value Vth may be affected by several factors such as the resistance change of the charging roller with environmental conditions, and the change of the charging gap due to dilation of the charging roller also caused by the change in environmental conditions.

This change is illustrated, for example, with the results included in Table 1 obtained from experimentation by the present inventor. In the table, the change in the voltage value Vth is shown as a function of absolute humidity which is taken as a representative of the environmental conditions.

TABLE 1

| | Absolute humidity [g/cm$^3$] | | | | |
|---|---|---|---|---|---|
| | 0≦ . . . <5 | 5≦ . . . <8 | 8≦ . . . <18 | 18≦ . . . <26 | 26≦ |
| Vth [V] | 2050 | 1840 | 1700 | 1670 | 1640 |

Influenced by the change in the voltage value Vth, there may give rise to the case where an AC voltage (peak-to-peak) applied to the charging roller is less than the voltage value of 2×Vth. In such a case, no discharge is generated from the charging roller to the photoreceptor, and the uniform charging of the photoreceptor cannot be attained.

In order to obviate this difficulty it may be contemplated that a higher voltage is applied to the charging roller. However, the higher voltage may make the amount of discharge unnecessarily high, the receptor surface deteriorated and some of its layer scraped off, and discharge reactants and toner additives unduly adhered to the surface, whereby satisfactory image qualities come to be difficult to achieve.

There disclosed in Japanese Laid-Open Patent Application No. 2002-108059 (i.e., the application '059) is environment detection means to be utilized for appropriately changing the AC voltage.

Namely, based on the results obtained by the environment detection means additionally provided, the AC voltage (peak-to-peak) is properly adjusted and applied to the charging roller.

By changing the AC voltage (peak-to-peak) corresponding to the environmental change, therefore, the amount of discharge sufficient for uniformly charging the photoreceptor can be obtained even after the change in the resistance of the charging roller or in the gap between the roller and photoreceptor. In addition, the surface deterioration can be prevented since the amount of discharge is kept not to be unnecessarily high.

In order to perform the environmental detection in the method, however, various AC voltage values corresponding to environmental conditions (temperature and humidity) have to be stored in memory means, this addition of the memory may result in a drawback of costs increase in the image forming apparatus.

On the other hand, it is also known that a photoreceptor can uniformly be charged without influenced by the gap change if the AC current to the photoreceptor is equal to, larger than the value Ivth of the AC current, which flows into the photoreceptor at the onset of the discharge from the charging roller to the photoreceptor.

The application '059 also discloses the method of controlling an AC voltage, in that the AC current Ivth uniformly charging the photoreceptor is obtained experimentally and the AC voltage is applied so as to bring the AC current equal to the value Ivth as standard AC current value.

Specifically, this method is carried out as follows; a predetermined AC voltage is applied to the charging roller during warm-up period prior to image forming operation and an AC current under the applied voltage is measured, and it is subsequently decided whether the thus measured value is the standard AC current value.

If the measured current value is equal to the standard AC current value or less, AC voltage applied to the charging roller is increased and the AC current value under the increased voltage is measured. After examining AC voltages by repeating these steps, the AC voltage applied to the charging roller is set so as to bring AC current value equal to Ivth as standard AC current value.

In the method of the application '059, however, a drawback is realized of taking a relatively long time before setting the AD voltage.

Namely, the steps in the method of determining the AC voltage value for bringing the AC current value equal to the standard AC current value Ivth are performed, as mentioned above, by repeating the following steps such as applying a predetermined AC voltage to the charging roller; measuring an AC current under the applied voltage; deciding whether the thus measured value is equal to, larger than the standard AC current value; increasing AC voltage applied to the charging roller if the measured current value is equal to the standard AC current value or less; and measuring the AC current value under the increased voltage, whereby it takes a relatively long time.

Another method is also known as the means for setting the AC voltage value to be applied to the charging roller such that the AC current flowing into the photoreceptor is equal to, larger than the standard AC current value.

That is, based on a relational expression between the AC voltage and AC current, the AC voltage which yields the standard AC current value Ivth is estimated, and the thus estimated AC voltage value is set as the AC voltage value to be applied to the charging roller.

It should be noted that the relation between the AC voltage and AC current may be affected by several factors such as the resistance change of the charging roller and the change in the charging gap.

As a result, even after applying the estimated AC voltage to the charging roller, there gives rise to the case where the AC current cannot be brought to be equal to the standard AC current value Ivth, as anticipated.

This gives rise to several difficulties such as the generation of unduly high amount of discharge, the concomitant deterioration of the surface of photoreceptor, or failure in uniform charging of the surface as a result of unsuccessful discharge.

SUMMARY OF THE INVENTION

Accordingly, it is an object of this invention to provide a method for controlling voltages applied to charging member having most, if not all, of the advantages and features of similarly employed charging methods, while reducing or eliminating many of the aforementioned disadvantages.

It is another object of the invention to provide a method of charging with electricity, capable of obviating the difficulty of taking a long time before properly setting the value of AC voltage which is applied to a charging member to bring a photoreceptor to uniform charging. Also provided are a charging unit for implementing the controlling method, and a process cartridge and an image forming apparatus incorporating the charging unit.

The following description is a synopsis of only selected features and attributes of the present disclosure. A more complete description thereof is found below in the section entitled "Description of the Preferred Embodiments."

To achieve the foregoing and other objects, and to overcome the shortcomings discussed above, a method is provided for controlling a voltage of a charging member for charging uniformly the surface of a charge receptor member by applying a DC voltage superposed with an AC voltage.

The method includes at least the steps of measuring a discharge onset voltage Vth for initiating a discharge to the charge receptor member by applying the DC voltage to the charging member;

a first detection current I pp1 flowing into the charge receptor member when a first AC voltage Vpp 1 of 2×Vth or larger is solely applied to the charging member; and a second detection current I pp2 flowing into the charge receptor member when a second AC voltage Vpp 2, which is 2×Vth or larger and different from the first AC voltage Vpp 1, is applied to the charging member;

deriving a relational expression between the AC voltage to be applied to the charging member and the AC current flowing into the charge receptor member in the range of 2×Vth or larger; and obtaining a third AC voltage Vpp 3 to be applied to the charging member by substituting a standard AC current value A, which is assumed in advance suffice for uniformly charging the charge receptor member, into the relational expression, in which, in the case when the AC current Ivpp 3, which flows into the charge receptor member under the third AC voltage Vpp 3 actually applied to the charging member, is within a predetermined range B, the third AC voltage Vpp 3 is set as the AC voltage to be applied to the charging member.

In another aspect, in the case when the AC current Ivpp 3 is not within the predetermined range B, a fourth AC voltage Vpp 4 is computed such that the AC voltage Vpp 4 yields the standard current value A, using the gradient of the relational expression, the third AC voltage Vpp 3, and the third AC current Ivpp 3; and subsequently set as the AC voltage to be applied to the charging member.

In still another aspect, in the case when the fourth AC voltage Vpp 4 computed previously is applied to the charging member as an n-th AC voltage Vpp (n), and when an AC current Ivpp (n), which flows into the charge receptor member under the n-th AC voltage Vpp (n) applied to the charging member, is not within the predetermined range B, the AC voltage value Vpp (n) is computed repeatedly until the AC current Ivpp (n) falls within the predetermined range B such that the AC voltage Vpp (n) yields the standard current value A, and then, when the AC current Ivpp (n) falls within the predetermined range B, the n-th AC voltage value Vpp (n) is set as the AC voltage to be applied to the charging member.

According to another embodiment, a charging unit is provided for charging the surface of a charge receptor member by applying a DC voltage superposed with an AC voltage with a charging member provided opposing to a charge receptor member.

The charging unit includes at least an AC current detection unit configured to detect a current flowing into the charge receptor member; a voltage determination unit configured to measure the discharge onset voltage Vth, the first detection current I pp1, and the second detection current I pp2, which are each specified above; to derive the abovementioned relational expression between the AC voltage and the AC current in the range of 2×Vth or larger; to obtain the third AC voltage Vpp 3 to be applied to the charging member; and a voltage setting unit configured, in the case when the AC current Ivpp 3, which flows into the charge receptor member under the third AC voltage Vpp 3 actually applied to the charging member, is within the predetermined range B, to set the third AC voltage Vpp 3 as the AC voltage to be applied to the charging member.

The voltage setting unit is additionally configured, (1) in the case when the AC current Ivpp 3 is not within the predetermined range B, to compute a fourth AC voltage Vpp 4 such that the AC voltage Vpp 4 yields the standard current value A, using the gradient of the relational expression, the third AC voltage Vpp 3, and the third AC current Ivpp 3, and to set as the AC voltage to be applied to the charging member, (2) in the case when the fourth AC voltage Vpp 4 computed previously is applied to the charging member as an n-th AC voltage Vpp (n), and when an AC current Ivpp (n), which flows into the charge receptor member under the n-th AC voltage Vpp (n) applied to the charging member, is not within the predetermined range B; to compute the AC voltage value Vpp (n) repeatedly n times until the AC current Ivpp (n) falls within the predetermined range B such that the AC voltage Vpp (n) yields the standard current value A, and then, when the AC current Ivpp (n) falls within the predetermined range B, to set the n-th AC voltage value Vpp (n) as the AC voltage to be applied to the charging member.

According to another embodiment, an image forming apparatus is provided, including at least an image bearing member, and a charging unit configured to charge the image bearing member.

The charging unit has a similar construction as mentioned above, including the AC current detection unit, the voltage determination unit, and the voltage setting unit.

According to still another embodiment, a process cartridge is provided detachably from the main chassis of an image forming apparatus, integrally including at least an image bearing member; and a charging unit configured to charge the image bearing member.

The charging unit has a similar construction as mentioned above, including the AC current detection unit, the voltage determination unit, and the voltage setting unit.

According to another embodiment, another image forming apparatus is provided, including at least a process cartridge provided detachably from the main chassis of the image forming apparatus, in which the process cartridge integrally includes an image bearing member; and a charging unit configured to charge the image bearing member.

The charging unit has a similar construction as mentioned above, including the AC current detection unit, the voltage determination unit, and the voltage setting unit.

These and other features and advantages of the invention will be more clearly seen from the following detailed description of the invention which is provided in connection with the accompanying drawings.

DETAILED DESCRIPTION OF PREFERRED EMBODIMENTS

Figure 1:
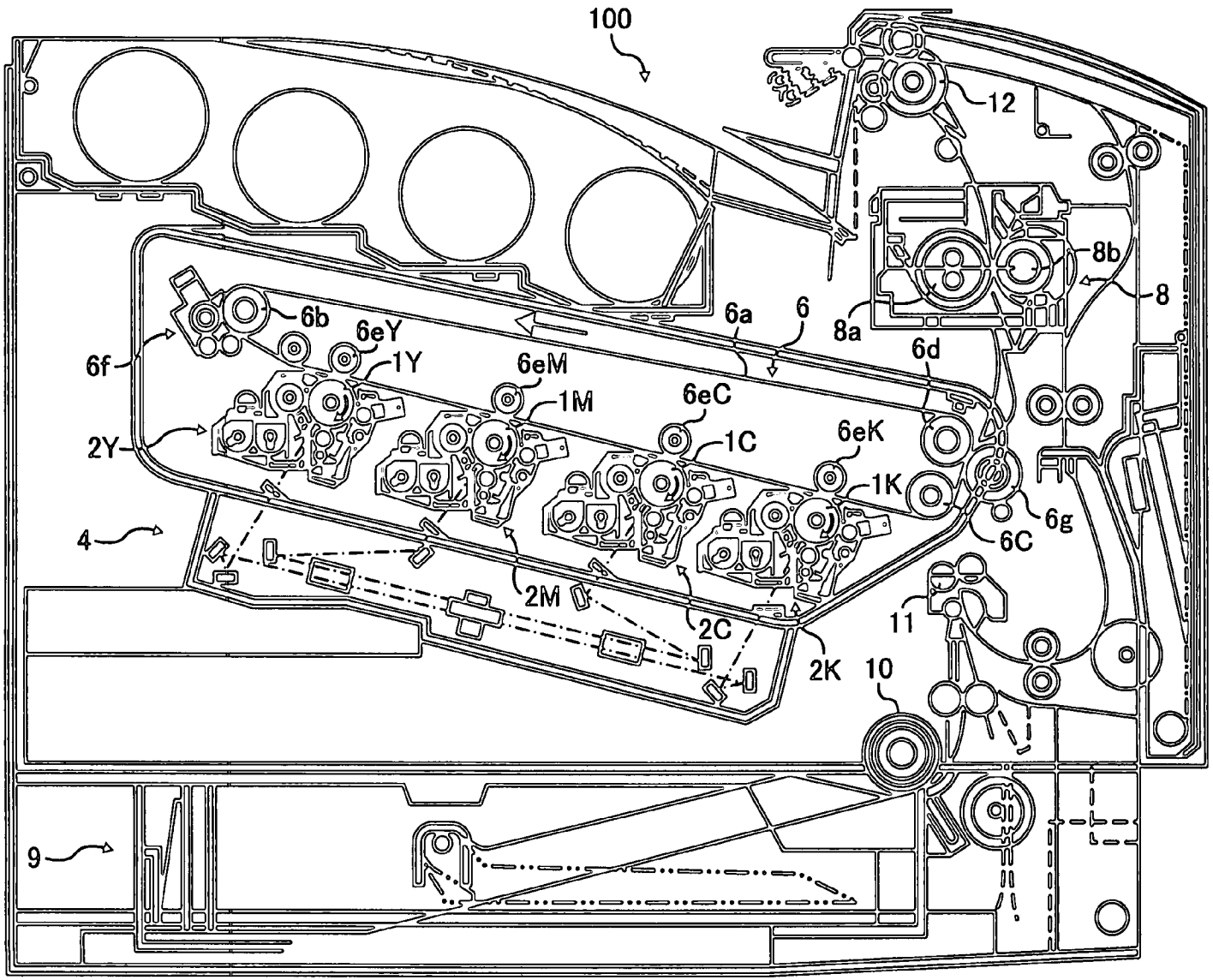
FIG. 1 is a schematic side view illustrating the overall construction of a printer as a color printer of quadruple tandem type.

In the detailed description which follows, specific embodiments of a charging control method and unit, and an image forming apparatus incorporating the charging unit are described, which are capable of obviating the aforementioned difficulties.

It is understood, however, that the present disclosure is not limited to these embodiments. For example, it is appreciated that the use of the method, unit, and apparatus included therein may also be adaptable to any form of image forming systems. Other embodiments will be apparent to those skilled in the art upon reading the following description.

According to an exemplary embodiment, a method is provided for controlling a voltage of a charging member for charging uniformly the surface of a charge receptor member by applying a DC voltage superposed with an AC voltage.

The method includes at least the steps of measuring a discharge onset voltage Vth, a first detection current I pp1, and a second detection current I pp2; deriving a relational expression; and obtaining a third AC voltage Vpp 3.

The step of measuring is configured to measure the discharge onset voltage Vth for initiating a discharge to the charge receptor member by applying the DC voltage to the charging member; the first detection current I pp1 flowing into the charge receptor member when a first AC voltage Vpp 1 of 2×Vth or larger is solely applied to the charging member; and the second detection current I pp2 flowing into the charge receptor member when a second AC voltage Vpp 2, which is 2×Vth or larger and different from the first AC voltage Vpp 1.

The step of deriving is configured to derive the relational expression between the AC voltage to be applied to the charging member and the AC current flowing into the charge receptor member in the range of 2×Vth or larger based on the first and second AC voltages Vpp 1 and Vpp 2 and on the first and second detection currents Ipp 1 and Ipp 2.

The step of obtaining is configured to obtain the third AC voltage Vpp 3 to be applied to the charging member by substituting a standard AC current value A, which is assumed in advance suffice for uniformly charging the charge receptor member, into the relational expression.

In this method, when the AC current Ivpp 3, which flows into the charge receptor member under the third AC voltage Vpp 3 actually applied to the charging member, is within a predetermined range B with respect to the standard AC current value A, the third AC voltage Vpp 3 is set as the AC voltage to be applied to the charging member.

In another aspect, in the case when the AC current Ivpp 3 is not within the predetermined range B, a fourth AC voltage Vpp 4 is computed such that the AC voltage Vpp 4 yields the standard current value A, using the gradient of the relational expression, the third AC voltage Vpp 3, and the third AC current Ivpp 3; and subsequently set as the AC voltage to be applied to the charging member.

In still another aspect, in the case when the fourth AC voltage Vpp 4 computed previously is applied to the charging member as an n-th AC voltage Vpp (n), and when an AC current Ivpp (n), which flows into the charge receptor member under the n-th AC voltage Vpp (n) applied to the charging member, is not within the predetermined range B, the AC voltage value Vpp (n) is computed repeatedly until the AC current Ivpp (n) falls within the predetermined range B such that the AC voltage Vpp (n) yields the standard current value A, and then, when the AC current Ivpp (n) falls within the predetermined range B, the n-th AC voltage value Vpp (n) is set as the AC voltage to be applied to the charging member.

According to another embodiment, a charging unit is provided for charging the surface of a charge receptor member by applying a DC voltage superposed with an AC voltage with a charging member provided opposing to a charge receptor member.

The charging unit includes at least an AC current detection unit, a voltage determination unit, and a voltage setting unit.

The AC current detection unit is configured to detect a current flowing into the charge receptor member.

The voltage determination unit is configured to measure a discharge onset voltage Vth for initiating a discharge to the charge receptor member by applying the DC voltage to the charging member; a first detection current I pp1 flowing into the charge receptor member when a first AC voltage Vpp 1 of 2×Vth or larger is solely applied to the charging member; and a second detection current I pp2 flowing into the charge receptor member when a second AC voltage Vpp 2, which is 2×Vth or larger and different from the first AC voltage Vpp 1; to derive a relational expression between the AC voltage to be applied to the charging member and the AC current flowing into the charge receptor member in the range of 2×Vth or larger based on the first and second AC voltages Vpp 1 and Vpp 2 and on the first and second detection currents Ipp 1 and Ipp 2; and to obtain a third AC voltage Vpp 3 to be applied to the charging member by substituting a standard AC current value A, which is assumed in advance suffice for uniformly charging the charge receptor member, into the relational expression.

The voltage setting unit is configured, in the case when the AC current Ivpp 3, which flows into the charge receptor member under the third AC voltage Vpp 3 actually applied to the charging member, is within the predetermined range B, to set the third AC voltage Vpp 3 as the AC voltage to be applied to the charging member.

The voltage setting unit is additionally configured, (1) in the case when the AC current Ivpp 3 is not within the predetermined range B, to compute a fourth AC voltage Vpp 4 such that the AC voltage Vpp 4 yields the standard current value A, using the gradient of the relational expression, the third AC voltage Vpp 3, and the third AC current Ivpp 3 and to set as the AC voltage to be applied to the charging member, and (2) in the case when the fourth AC voltage Vpp 4 computed previously is applied to the charging member as an n-th AC voltage Vpp (n), and when an AC current Ivpp (n), which flows into the charge receptor member under the n-th AC voltage Vpp (n) applied to the charging member, is not within the predetermined range B; to compute the AC voltage value Vpp (n) repeatedly n times until the AC current Ivpp (n) falls within the predetermined range B such that the AC voltage Vpp (n) yields the standard current value A, and, when the AC current Ivpp (n) falls within the predetermined range B, and to set the n-th AC voltage value Vpp (n) as the AC voltage to be applied to the charging member.

In addition, the charging unit in the invention is provided with an upper limit D specifying the number C of repetitions for computing the AC current Ivpp (n).

Still in addition, the charging unit is configured, in the case when the number C of repetitions exceeds the upper limit D, (1) to be turned off promptly, and (2) for the AC voltage Vpp (n), which is used for setting the preceding AC voltage, to be applied to the charging member.

According to another embodiment, an image forming apparatus is provided including at least an image bearing member, and a charging unit configured to charge the surface of a charge receptor member by applying a DC voltage superposed with an AC voltage with a charging member provided opposing to a charge receptor member.

The charging unit includes at least an AC current detection unit, a voltage determination unit, and a voltage setting unit.

The AC current detection unit is configured to detect a current flowing into the charge receptor member.

The voltage determination unit is configured to measure a discharge onset voltage Vth for initiating a discharge to the charge receptor member by applying the DC voltage to the charging member; a first detection current I pp1 flowing into the charge receptor member when a first AC voltage Vpp 1 of 2×Vth or larger is solely applied to the charging member; and a second detection current I pp2 flowing into the charge receptor member when a second AC voltage Vpp 2, which is 2×Vth or larger and different from the first AC voltage Vpp 1; to derive a relational expression between the AC voltage to be applied to the charging member and the AC current flowing into the charge receptor member in the range of 2×Vth or larger based on the first and second AC voltages Vpp 1 and Vpp 2 and on the first and second detection currents Ipp 1 and Ipp 2; and to obtain a third AC voltage Vpp 3 to be applied to the charging member by substituting a standard AC current value A, which is assumed in advance suffice for uniformly charging the charge receptor member, into the relational expression.

The voltage setting unit is configured, in the case when the AC current Ivpp 3, which flows into the charge receptor member under the third AC voltage Vpp 3 actually applied to the charging member, is within the predetermined range B, to set the third AC voltage Vpp 3 as the AC voltage to be applied to the charging member.

The voltage setting unit is additionally configured, (1) in the case when the AC current Ivpp 3 is not within the predetermined range B, to compute a fourth AC voltage Vpp 4 such that the AC voltage Vpp 4 yields the standard current value A, using the gradient of the relational expression, the third AC voltage Vpp 3, and the third AC current Ivpp 3 and to set as the AC voltage to be applied to the charging member, and (2) in the case when the fourth AC voltage Vpp 4 computed previously is applied to the charging member as an n-th AC voltage Vpp (n), and when an AC current Ivpp (n), which flows into the charge receptor member under the n-th AC voltage Vpp (n) applied to the charging member, is not within the predetermined range B; to compute the AC voltage value Vpp (n) repeatedly n times until the AC current Ivpp (n) falls within the predetermined range B such that the AC voltage Vpp (n) yields the standard current value A, and, when the AC current Ivpp (n) falls within the predetermined range B, and to set the n-th AC voltage value Vpp (n) as the AC voltage to be applied to the charging member.

According to still another embodiment, a process cartridge is provided detachably from the main chassis of an image forming apparatus, integrally including at least an image bearing member and a charging unit configured to charge the image bearing member.

The charging unit has a similar construction as mentioned above, including the AC current detection unit, the voltage determination unit, and the voltage setting unit.

According to another embodiment, another image forming apparatus is provided, including at least a process cartridge provided detachably from the main chassis of the image forming apparatus, in which the process cartridge integrally includes an image bearing member; and a charging unit configured to charge the image bearing member.

The charging unit has a similar construction as mentioned above, including the AC current detection unit, the voltage determination unit, and the voltage setting unit.

Having described the present disclosure in general, the features of charging units and image forming apparatuses incorporating the charging units of the invention will be detailed herein below.

In the first place, an exemplary embodiment of image forming apparatus will be described according to the present invention. This image forming apparatus is a full-color laser printer and hereinafter referred to as "printer."

FIG. 1 is a schematic side view illustrating the overall construction of a printer 100.

Referring to FIG. 1, the printer 100 as a color printer of quadruple tandem type is configured to form full-color images using toners in four colors Y (yellow), M (magenta), C (cyan), and K (black). In addition, the printer 100 is provided with four photoreceptor units 1Y, 1M, 1C, and 1K.

The photoreceptor units 1Y, 1M, 1C, and 1K are each driven with respective driving units (not shown) to rotate in the direction designated by the arrow A in the drawing so as to be brought into contact with an intermediate transfer belt 6*a* serving as a surface displacing member.

Figure 2:
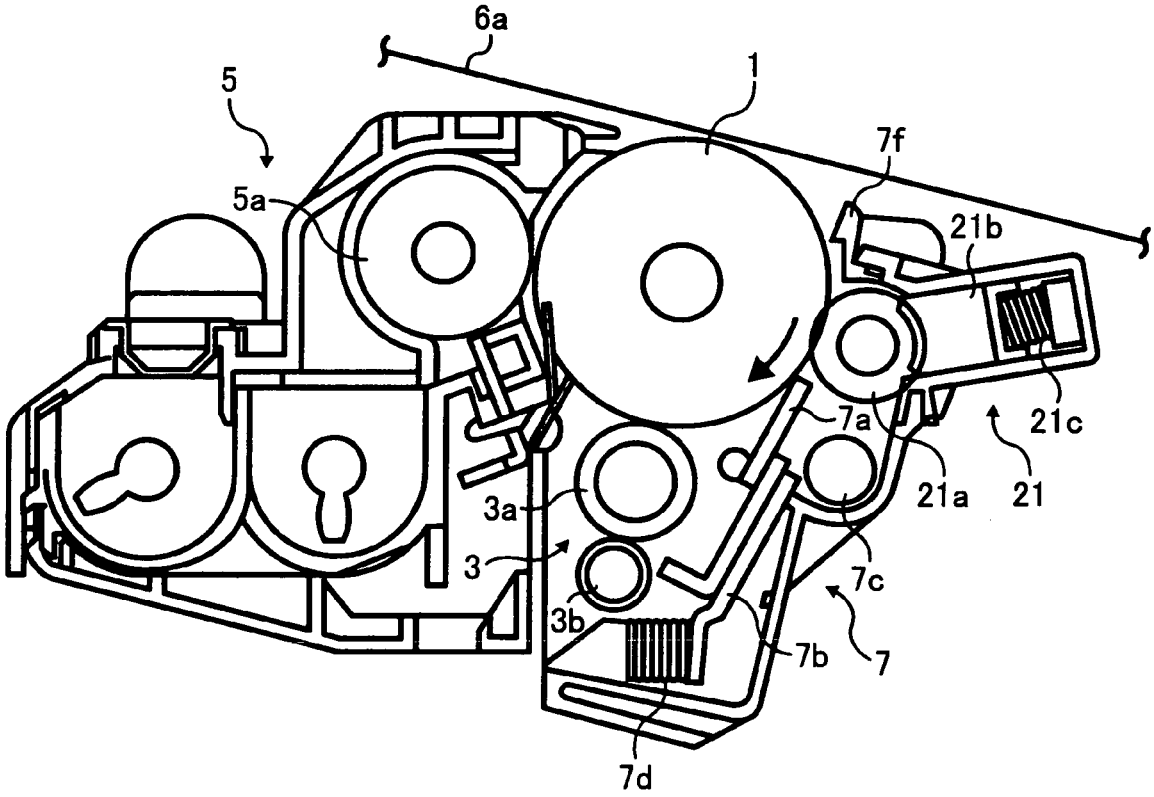
FIG. 2 is a schematic side view illustrating a photoreceptor unit included in an image forming unit.

As illustrated in FIG. 2, the photoreceptor units 1Y, 1M, 1C, and 1K are included in image forming units 2Y, 2M, 2C, and 2K, respectively.

Since respective photoreceptor units (1Y, 1M, 1C, and 1K) are formed with similar photoreceptor units (1Y, 1M, 1C, and 1K) and peripheral units, the indices Y, M, C, and K are hereinafter abbreviated for purposes of clarity.

On the outer periphery of the photoreceptor unit 1, there provided in the direction of the surface displacement are a developer unit 5 configured to render latent images into toner images through visualization, a lubricant coating unit 21 configured to coat the surface of the photoreceptor unit 1 with a lubricant, a cleaning unit 7 configured to remove residual toner particles remaining on the photoreceptor unit 1, and a charging unit 3 configured to charge the photoreceptor unit 1.

The developer unit 5 is provided with a developing roller 5*a* as a developer supporting member which is positioned to be partially exposed through an opening leading to a developer casing.

Although the developer unit 5 is designed in the present embodiment to operate with two component developers consisting of carrier granules and toner particles, single or monocomponent developers may alternatively used without the carriers.

The developer unit 5 is configured to have toner particles which have the color same as those already contained in the two component developers supplied from a toner bottle and subsequently admixed there into.

The developing roller 5*a* includes a magnet roller and developer sleeves which are provided coaxially with respect to the roller 5*a* to be driven rotatably.

While the carrier granules included in the developer are formed as bristles on the developing roller 5*a* by magnetic force exerted by the magnet roller, they are carried to a developing region between the photoreceptor unit 1 and the developing roller 5*a* opposing with one another.

In addition, the developing roller 5*a* is designed in the developing region facing the photoreceptor unit 1 to rotate in the same direction as, with a linear speed higher than, the surface of the photoreceptor unit 1.

The carrier granules thus bristled on the developing roller 5*a* are subsequently displaced while rubbing over the surface area of the photoreceptor unit 1 whereby toner particles can be supplied onto the surface area and the development of electrostatic latent images on the photoreceptor unit 1 are performed.

A developing bias is applied during the development from a power source (not shown) to the developing roller 5*a* and a developing electric field is generated as a result.

The lubricant coating unit 21 includes at least a molded lubricant 21*b* accommodated in a fixed case; a brush roller 21*a* for coming into contact with the molded lubricant 21*b*, and shaving off, then coating the photoreceptor unit 1 with, a portion of the molded lubricant 21*b*; and a first spring member 21*c* for pressing the molded lubricant 21*b* toward the brush roller 21*a*.

The molded lubricant 21*b* is formed in the shape of a rectangular parallelepiped, and the brush roller 21*a* is in the form elongated in the direction of the axis of the photoreceptor unit 1.

In addition, the molded lubricant 21*b* is pressed toward the brush roller 21*a* with the first spring member 21*c* such that the block of the molded lubricant 21*b* can be used up almost in its entirety.

Although the molded lubricant 21*b* is an expendable good and the thickness thereof decreases with time during usage, the lubricant 21*b* is always kept pressed to the brush roller 21*a* with the pressurizing force exerted from the first spring member 21*c*.

Moreover, the lubricant coating unit 21 may alternatively be provided in the cleaning unit 7 in combination with a cleaning blade 7*a* serving as a cleaning means.

With this construction of the cleaning unit 7, the portion of toner particles attached to the roller 21*a* can be recovered with relative ease by displacing while rubbing the photoreceptor unit 1 with the brush roller 21*a* and scraping off either with the brush roller 21*a* or a flick-knife.

Examples of the materials suitable for the lubricant include fatty acid salts, silicone oil, and fluorocarbon resins, which may be used individually or in combination.

In addition, examples of the fatty acid salts preferably include, but not limited to lead stearate, magnesium stearate, aluminum stearate, calcium stearate, and iron stearate. The lead stearate is used more preferably.

Among the lubricant materials, pulverized particles of lead stearate, calcium stearate, or fluorocarbon resin particles may be compounded into a mold serving as the molded lubricant 21*b*.

The cleaning unit 7 includes the cleaning blade 7*a*, a supporting member 7*b* for supporting the cleaning blade 7*a*, a toner recycling coil 7*c*, and a second spring member 7*d* for pressing the cleaning blade 7*a* toward the photoreceptor unit 1.

The cleaning blade 7*a* is adapted to remove residual toner particles remaining on the photoreceptor unit 1 after the image transfer.

As a material for forming the cleaning blade 7*a*, thermosetting urethane resin may suitably be used. A urethane elastomer is preferably used for its excellent tolerance for abrasion, ozone, and contamination. The elastomer herein may include rubber.

The charging unit 3 includes a charging roller 3*a* serving as a charging member provided to be in contact with to the photoreceptor unit 1, and a charging cleaning member 3*b* for cleaning the charging roller 3*a*, which is provided to be brought into contact with the charging roller 3*a* on the side opposite to the point of the contact of the roller 3*a* and the photoreceptor unit 1.

Figure 3:
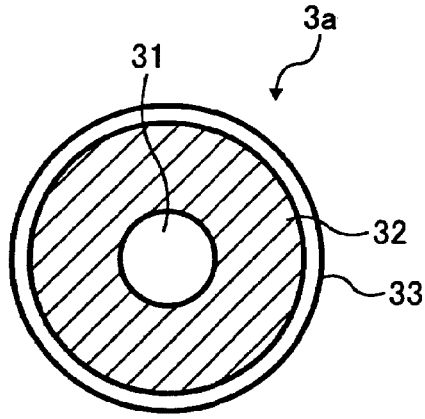
FIG. 3 is a cross-sectional view of the charging roller according to one embodiment of the invention.

FIG. 3 is a cross-sectional view of the charging roller 3*a* according to one embodiment of the invention.

Referring to FIG. 3, the charging roller 3*a* includes a rotating core shaft 31 of a metal bar (or metal core shaft) as an electro-conductive supporting member, a resistance adjusting layer 32 with a uniform thickness formed around the metal core shaft 31, and a protective layer 33 formed over the outer surface of the resistance adjusting layer 32 for preventing leakage.

In each of image forming units 2Y, 2M, 2C, and 2K, at least one of the photoreceptor unit (1Y, 1M, 1C, or 1K), the charging unit 3, the developer unit 5, the lubricant coating unit 21, and the cleaning unit 7 may be formed integrally as a process cartridge. In addition, the process cartridge may be provided detachably from the main chassis of the image forming apparatus.

Figure 4:
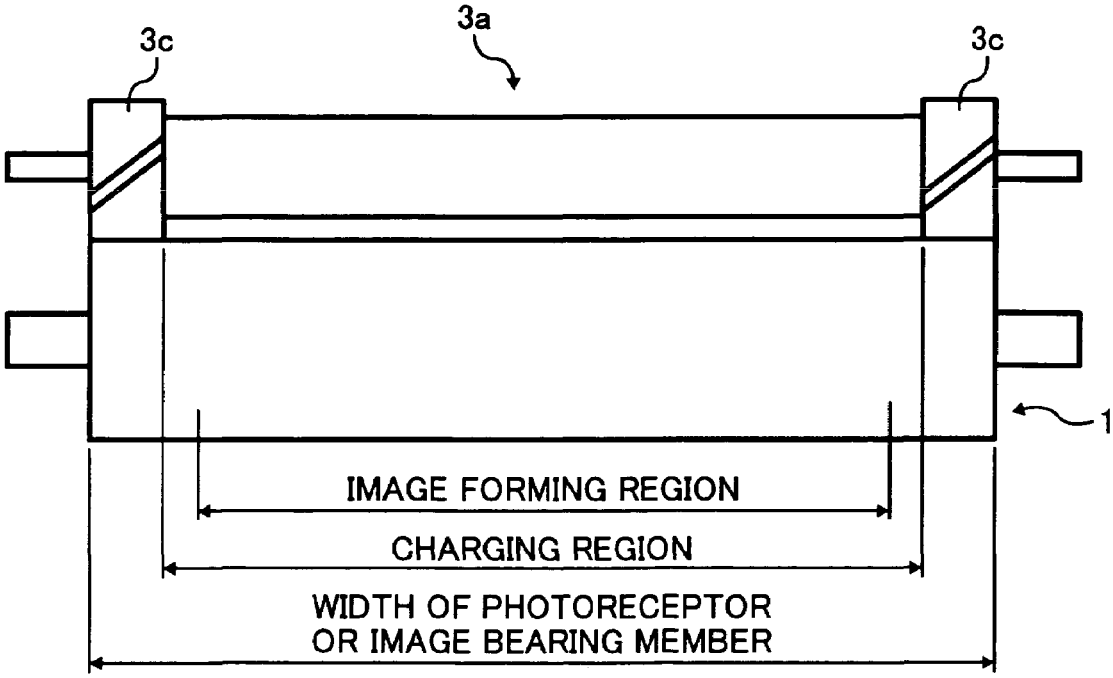
FIG. 4 is a sectional view of a charging roller and a photoreceptor installed in the image forming unit.

FIG. 4 is a sectional view of a charging roller 3*a* and a photoreceptor 1 installed in the image forming apparatus.

Referring to FIG. 4, the charging roller 3*a* is provided with gap holding members 3*c*, 3*c* each formed of non-conductive sheets at both ends of the charging roller 3*a* corresponding to non-image forming region of the photoreceptor 1.

The gap holding members 3*c*, 3*c* each come into contact with the non-image forming region of the photoreceptor 1, and the charging roller 3*a* and the photoreceptor 1 are brought to rotate with each other.

Moreover, there maintained is a non-contact arrangement between the photoreceptor 1 and the charging roller 3*a* having a predetermined gap therebetween formed with the intervening gap holding members 3*c*, 3*c*.

Figure 5:
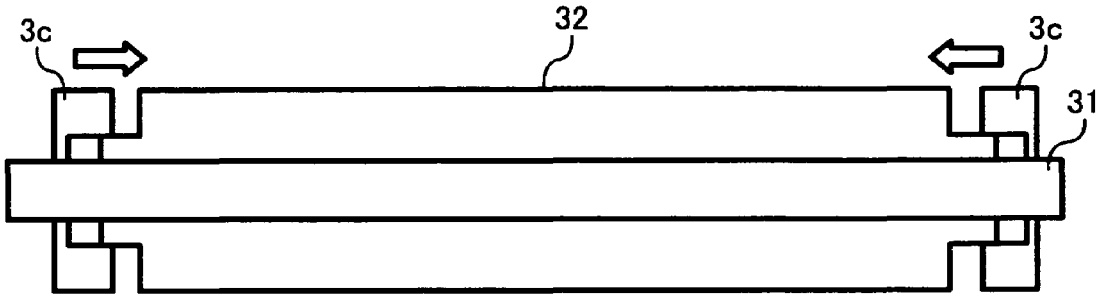
FIGS. 5 and 6 are cross-sectional views illustrating a charging roller 3*a* during fabrication steps according to one embodiment of the invention.
Figure 6:
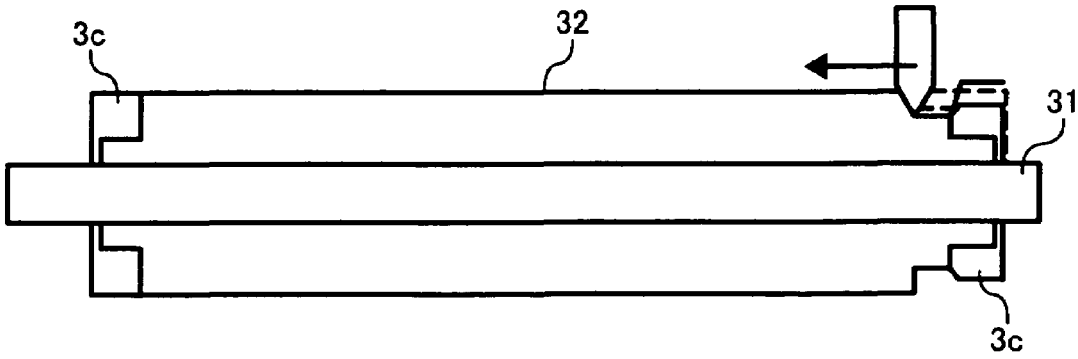

FIGS. 5 and 6 are cross-sectional views illustrating a charging roller 3*a* during fabrication steps according to one embodiment of the invention.

Referring first to FIG. 5, step portions are formed at both ends each having a certain depth in the radial direction of the resistance adjusting layer 32, and gap holding members 3*c*, 3*c* are affixed onto the respective ends onto the step portions through at least one of processing methods such as press fitting and adhesive joining.

Subsequently, as shown in FIG. 6, the resistance adjusting layer 32 and gap holding members 3*c*, 3*c* are subjected to machining process steps such as cutting, whereby a height difference is formed between the resistance adjusting layer 32 and gap holding members 3*c*.

As a result of the abovementioned formation of the charging roller 3*a*, the dispersion in the height difference is reduced to 10 μm or smaller.

Thereafter, a protective layer 33 is formed over the resistance adjusting layer 32 by dipping, for example.

The charging roller 3*a* is electrically connected to a power source so that a predetermined voltage is applied to the metal core shaft 31 from the power source.

The predetermined voltage in the present embodiment is generated by superposing an AC voltage on a DC voltage, such that a desired magnitude of charging potential on the surface of the photoreceptor unit 1 is attained by applying AC voltage (peak-to-peak Vpp) to the metal core shaft 31 and by flowing a predetermined AC current into the photoreceptor unit 1.

As shown in FIG. 1, an exposure unit 4 is configured to regulate plural light sources according to image data from exterior of respective colors yellow, cyan, magenta, and black, generate light beams modulated by the image data of respective colors, and carry out a deflective scanning of the modulated light beams with a scanning optics including a deflector, to thereby irradiate the photoreceptor units 1 (1Y, 1M, 1C, and 1K) of image forming units 2 (2Y, 2M, 2C, and 2K), respectively.

The photoreceptor units 1 are each rotated with driving units including drive motors and the surfaces of the photoreceptor units 1 are uniformly charged by charging rollers 3*a*. By irradiating while scanning the surface of the photoreceptor units, as described above, latent images are formed.

The latent images formed on the photoreceptor units 1 are then rendered visible through development with respective development units 5, whereby toner images of the colors yellow, cyan, magenta, and black are formed.

The intermediate transfer belt 6*a* included in the transfer unit 6 is suspended and tension wound around three supporting rollers 6*a*, 6*b*, and 6*c*. In addition, one of the supporting rollers with a driving unit (not shown) is adapted to drive the intermediate transfer belt 6*a* in the direction designated with the arrow in the drawing.

The toner images of respective colors respectively formed on the photoreceptor units 1Y, 1M, 1C, and 1K are transferred sequentially with the electrostatic transfer method onto the intermediate transfer belt 6*a* to be superimposed with each other, whereby quadruple-color (full-color) images are formed.

Although a means for using a transfer charger may be adapted in the electrostatic transfer method, one with transfer rollers (6*e*Y, 6*e*M, 6*e*C, and 6*e*K) is adopted in the present embodiment, which is considered to generate few dust particles during transfer.

Specifically, primary transfer rollers 6*e*Y, 6*e*M, 6*e*C, and 6*e*K as respective transfer means are provided at the locations on the intermediate transfer belt 6*a* behind the points in contact with the photoreceptors 1Y, 1M, 1C, and 1K, respectively.

First transfer regions are thus formed as the ones defined by the portions of the intermediate transfer belt 6*a* in pressed contact with the primary transfer rollers 6*e* and the photoreceptors.

During the transfer of the toner images on the photoreceptor units 1Y, 1M, 1C, and IK onto the intermediate transfer belt 6*a*, a positive bias voltage is applied to the primary transfer rollers 6*e* from the power source.

As a result, transfer electric fields are formed in the first transfer regions, the toner images on the photoreceptor units 1Y, 1M, 1C, and 1K are electrostatically adhered onto the intermediate transfer belt 6*a*, and thereby the image transfer attaining is attained.

A belt cleaning unit 6*f* is provided on the outer periphery of the intermediate transfer belt 6*a* for removing toner particles remaining on the surface of the belt 6*a*. This belt cleaning unit 6*f* has a structure including a fur brush and a cleaning blade for recycling disused toner particles. Thus recovered toner particles are conveyed out of the belt cleaning unit 6*f* to a disused toner tank (not shown) with a conveyance means (not shown).

In addition, the secondary transfer roller 6*g* is provided to be brought into contact with the portion of the intermediate transfer belt 6*a* which is suspended and tension wound around the support roller 6*d*.

A secondary transfer region is then formed between the intermediate transfer belt 6*a* and the secondary transfer roller 6*g*, to where a copysheet is forwarded at a predetermined timing as an image recording medium. The copysheet is previously stored in a sheet feeding cassette 9 situated under the exposure unit 4, and forwarded to the secondary transfer region by way of a pickup roller 10 and a registration roller pair 11.

Thereafter, the full color images formed on intermediate transfer belt 6*a* is collectively transferred into the secondary transfer region on the copysheet.

During the secondary transfer, another positive bias voltage is applied to the secondary transfer roller 6*g* from a power source (not shown). With a transfer electric field thus formed the toner images on the intermediate transfer belt 6*a* are transferred on the copysheet.

A heated fixing unit 8 as a fixing means is provided downstream of the secondary transfer region in the sheet feeding direction.

The heated fixing unit 8 includes a heating roller 8*a* having a heating element built-in and a pressure roller 8*b*.

After passing through the secondary transfer region, the copysheet is further forwarded into a fixing nip consisting of the rollers 8*a* and 8*b* to be subjected to heating under pressure for the toner images on the copysheet to be fused, whereby the toner images are fixed permanently onto the copysheet.

The copysheet is discharged to a sheet output tray provided on the upper face of the apparatus by way of a sheet discharging roller 12.

The photoreceptor units 1 (1Y, 1M, 1C, and 1K) of respective image forming units 2 (2Y, 2M, 2C, and 2K) are each applied with a lubricant by the lubricant coating units 21, as shown in FIG. 2, and cleaned with cleaning blades 7*a* of the cleaning equipment 7, respectively.

In the printer 100 of the present embodiment, a process control action (which is hereinafter referred to as "pro-con action") is performed for properly adjusting image density for each color when the machine power is turned on or after a predetermined number of sheets are printed.

In the pro-con action, several patches (which are hereinafter referred to as "P patterns") are formed in use for detecting toner concentration on respective photoreceptors.

Namely, the P patterns on each of 1Y, 1M, 1C, and 1K photoreceptors are formed by successively switching on both the charging bias voltage applied to the charging roller 3*a* in the charging unit 3 from a power source and the developing bias voltage applied to the developing roller 5*a* in the developer unit 5 from another power source. This switching is carried out with a controlling means, which will be described later on, at a proper timing so that the P patterns of respective colors are formed on the intermediate transfer belt 6*a* not to be overlapped with one another.

The image density of the P patterns formed on intermediate transfer belt 6*a* are measured with a density detection sensor serving as an optical detection means, which is provided in the vicinity of the supporting roller 6*c* and outside of the intermediate transfer belt 6*a*.

As will be detailed later on, the controlling means is configured to (1) compute the values (development γ and Vk) indicative of present development capability of respective development units 5 through the conversion of the output voltage obtained by the concentration detection sensor into the amount of toner adhesion with a toner adhesion amount conversion algorithm (powder adhesion amount conversion method), and (2) perform the control to change the values of the development bias voltage for the developing roller 5*a* of respective development equipments 5 and the target values for toner concentration, based on the values (development γ and Vk) obtained as above.

In the next place, there described is a voltage control method configured to control the voltage of the charging means of the present embodiment.

Figure 7:
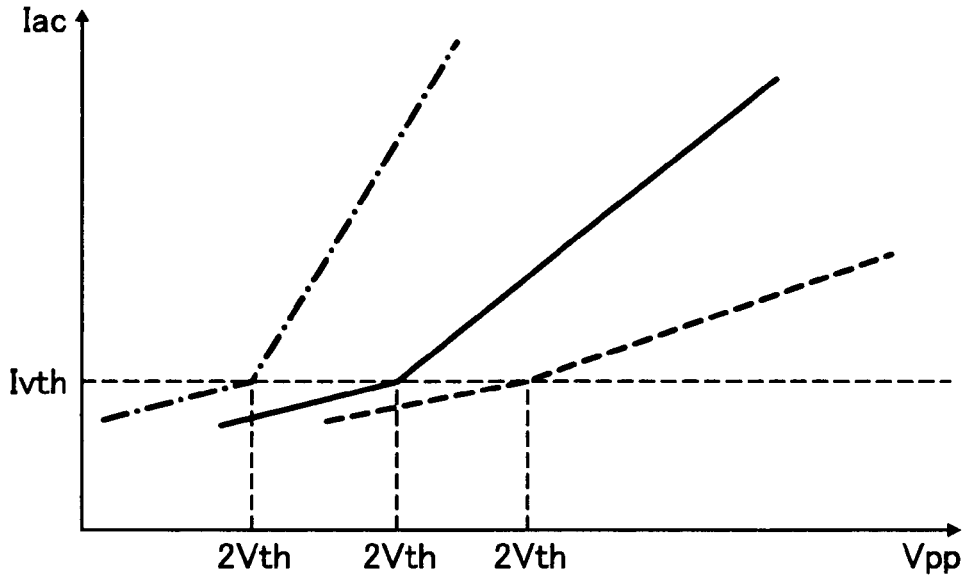
FIG. 7 plots the AC current which flows into the photoreceptor, vertically, versus the AC voltage (peak-to-peak voltage) applied to the charging roller, horizontally, comparing the current-voltage relation for several values of the gap between the photoreceptor and the charging roller.

FIG. 7 plots the AC current which flows into the photoreceptor 1 with AC voltage (peak-to-peak voltage) applied to the charging roller 3*a*, vertically, versus the AC voltage (peak-to-peak voltage) applied to the charging roller 3*a*, horizontally, comparing the current-voltage relation for several values of the gap between the photoreceptor 1 and the charging roller 3*a*.

The solid lines of FIG. 7 illustrate the change in the AC current with increasing the AC voltage for the gap between the photoreceptor 1 and the charging roller 3*a* to be the standard value G.

The broken lines of FIG. 7 illustrate the change in the AC current with the increase in the AC voltage for the gap larger than the standard value G.

In addition, the dashed lines illustrate the change for the gap smaller than the standard value G.

As shown in FIG. 7, the magnitude of the gradient of the straight line indicative of the AC current versus the AC voltage relationship gives rise to a clear change at the 2×Vth value of Vpp. The reason for this change is considered to be due to the fact that (1) in the case when the value of the AC voltage is 2×Vth or smaller, both the charging roller 3*a* and the photoreceptor 1 operate as a capacitor, (2) the increase in the AC current flowing into the photoreceptor 1 is relatively small, and (3) the gradient of the linear relationship stays small as a result.

In the case of the AC voltage of 2×Vth or larger, by contrast, electric discharge takes place between the charging roller 3*a* and the photoreceptor 1 and the AC current value flowing into the photoreceptor increases, whereby the gradient of the linear relationship increases.

FIG. 7 also indicates that the 2×Vth values change considerably depending on the value of the gap, while the AC value remains approximately constant even after the change in the gap value. That is, if the AC current flowing into the photoreceptor is adjusted to have a predetermined value, the amount of the discharge to the photoreceptor can be kept constant and the photoreceptor 1 is brought to a desirable charging voltage.

A voltage determination means is provided in the present embodiment, which is configured to (1) obtain the value of AC voltage which is applied to the charging roller 3*a* such that AC current flowing into the photoreceptor is brought to a predetermined value (hereinafter referred to as standard AC current A), and (2) determine thus obtained AC voltage value as a standard voltage value Vpp_aim.

The standard voltage value (peak-to peak voltage) Vpp_aim is then superposed on the afore-noted DC voltage to be applied to the charging roller 3*a*.

In the next place, there described herein below is the method in the present embodiment of calculating the standard voltage value Vpp_aim.

As indicated with the plots of FIG. 7 regarding to the change in AC voltage with AC current, the gradient for the Vpp region above the 2×Vth value changes considerably with the gap value.

Since a relatively high discharge voltage is required when the gap of the photoreceptor 1 and the charging roller 3*a* is large, the gradient become smaller than the case of smaller gap value. In addition, the gradient may also be affected by the resistance change of the charging roller 3*a* caused by environmental changes and dust adhesion thereto.

The gradient is therefore determined in the present embodiment by (1) first deriving a relational expression of the AC voltage as a function of the AC current in the range of 2×Vth or larger, and (2) computing the voltage value Vpp_aim to be determined through the substitution of the standard AC current value A into the relational expression.

Figure 8:
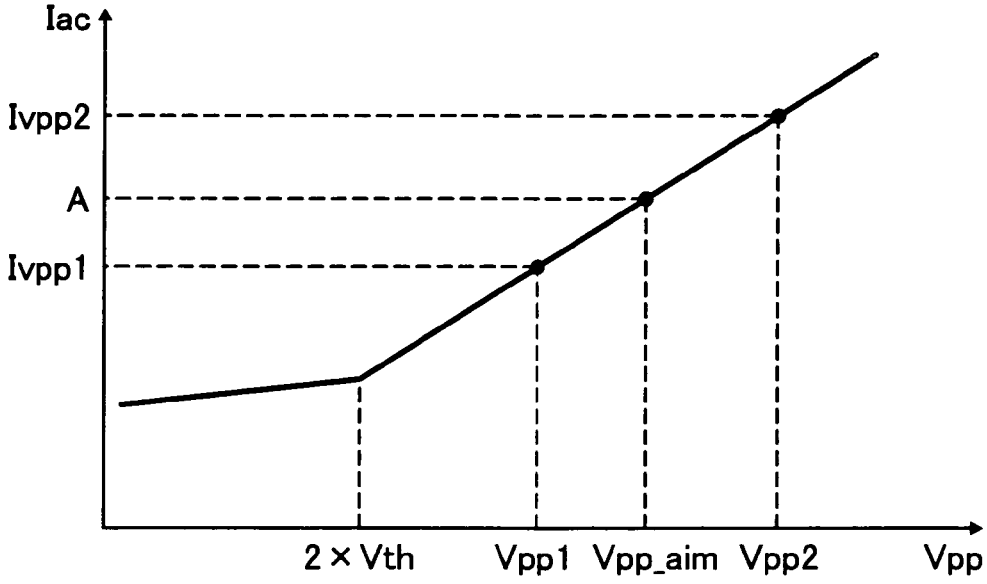
FIG. 8 is a graphical plot for illustrating the relation of the AC voltage versus the AC current in use for explaining the method of calculating the standard voltage value Vpp_aim.

FIG. 8 is a graphical plot for illustrating the relation of the AC voltage versus the AC current in use for explaining the method of calculating the standard voltage value Vpp_aim.

First, a first detection voltage (Vpp 1) as a first AC voltage is applied to the charging roller 3*a*, and AC current flowing into the photoreceptor 1 under this voltage is measured as a first detection current Ipp 1.

Next, a second detection voltage (Vpp 2) as a second AC voltage is applied to the charging roller 3*a*, and the AC current flowing into the photoreceptor 1 under this voltage is measured as a second detection current Ipp 2.

Subsequently, a first expression is derived by substituting the first detection voltage (Vpp 1) and the first detection current Ipp 1 into the above noted relational expression of the AC voltage versus AC current in the range of 2×Vth or larger (i.e., Iac=a×Vpp+b), and a second expression is similarly derived by substituting the second detection voltage (Vpp 2) and the second detection current Ipp 2.

Thereafter, the parameters in the relational expression, such as slope or gradient a and intercept b, are obtained by solving the simultaneous equations consisting first and second expressions, whereby the relational expression of the AC voltage versus AC current in the range of 2×Vth or larger is derived.

The standard voltage value Vpp_aim is thereafter computed by substituting the standard AC current value A into the relational expression mentioned just above.

In addition, there described herein below is the current detection means in the present embodiment for detecting the current flowing into a power supply circuit for the charging unit 3 and to the photoreceptor 1.

Figure 9:
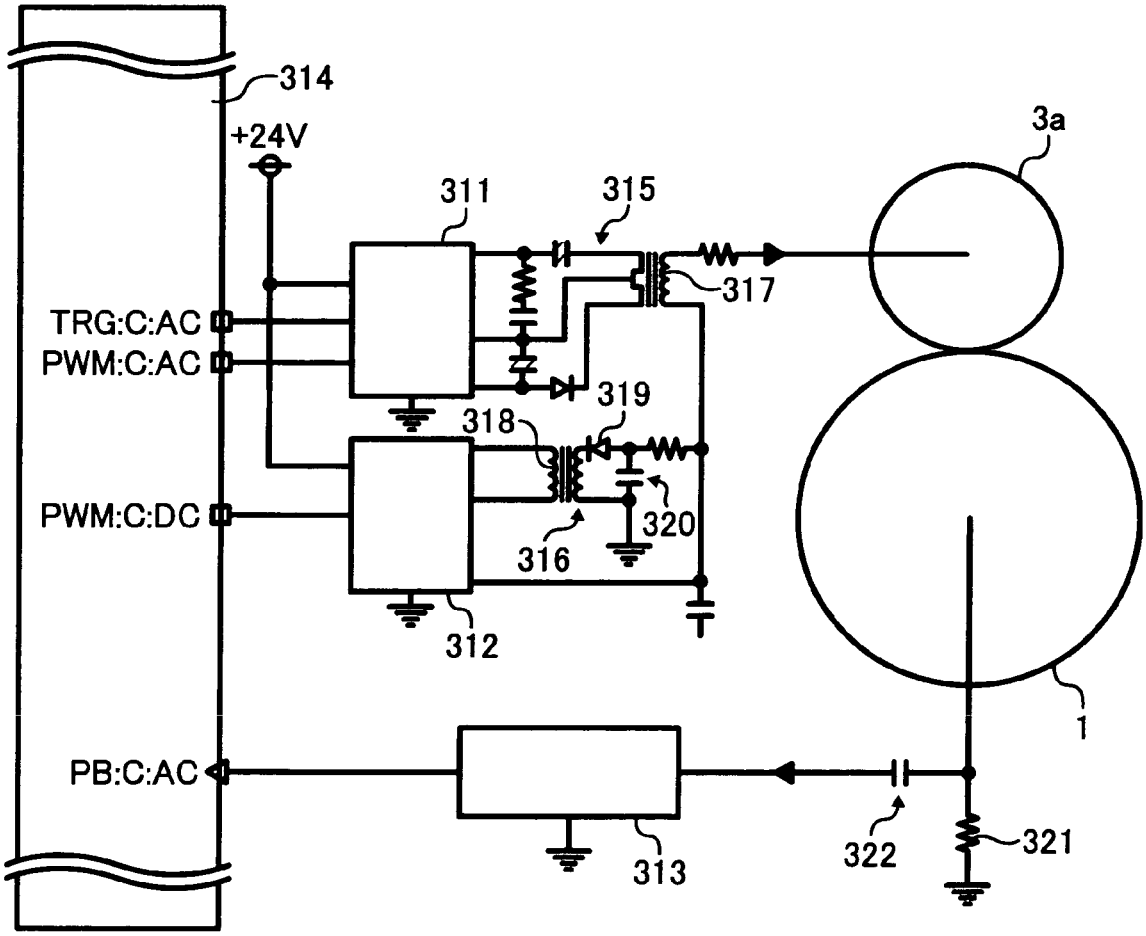
FIG. 9 is a diagrammatical circuit diagram illustrating the power supply circuit for the charging unit according to one embodiment of the invention, which serves as a power source for applying charging bias to the charging roller and AC current detection means.

FIG. 9 is a diagrammatical circuit diagram illustrating the power supply circuit for the charging unit 3 (which serves as a power source for applying charging bias to the charging roller 3*a* and AC current detection means (which is hereinafter referred to simply as current detection means).

Referring to FIG. 9, the power supply circuit includes an AC output circuit 311 and a DC output circuit 312. In addition, by further incorporating two step-up means 315 and 316, the power supply circuit is configured to supply stable discharge voltages.

Although this step-up function may be achieved by one step-up unit, the two-step-up configuration as noted above is preferred from the consideration of output stability.

That is, the step-up means 315 is adapted to boost AC voltage with a transformer 317. In addition, the step-up means 316 is adapted to boost another AC voltage with a transformer 318, rectify the voltage with a rectifier circuit composed of a diode 319 and a capacitor 320, and thereafter the resulting DC voltage is superposed on the AC output from AC output circuit 311.

On applying the above voltage formed by superimposing AC voltage on the DC voltage to the charging roller 3*a*, an AC current flows into an AC current feedback circuit including a resistance 321 by way of the charging roller 3*a* and the photoreceptor 1.

An AC detection means 313 is provided on the side of the ground of the photoreceptor 1, which is configured to detect solely AC current flowing into the photoreceptor 1 (through the detection of the voltage of the resistor 321 with a capacitor 322), and to input the output detected as above to a control substrate 314.

Although the AC detection means 313 is mounted on the same substrate as the power supply circuit serving the charging unit 3 from maintenance point of view, it may also be possible for the AC detection means 313 be placed on the control substrate 314. The control substrate 314 herein is included in a control means.

Still in addition, there described herein below is the voltage detection means in the present embodiment.

Figure 10:
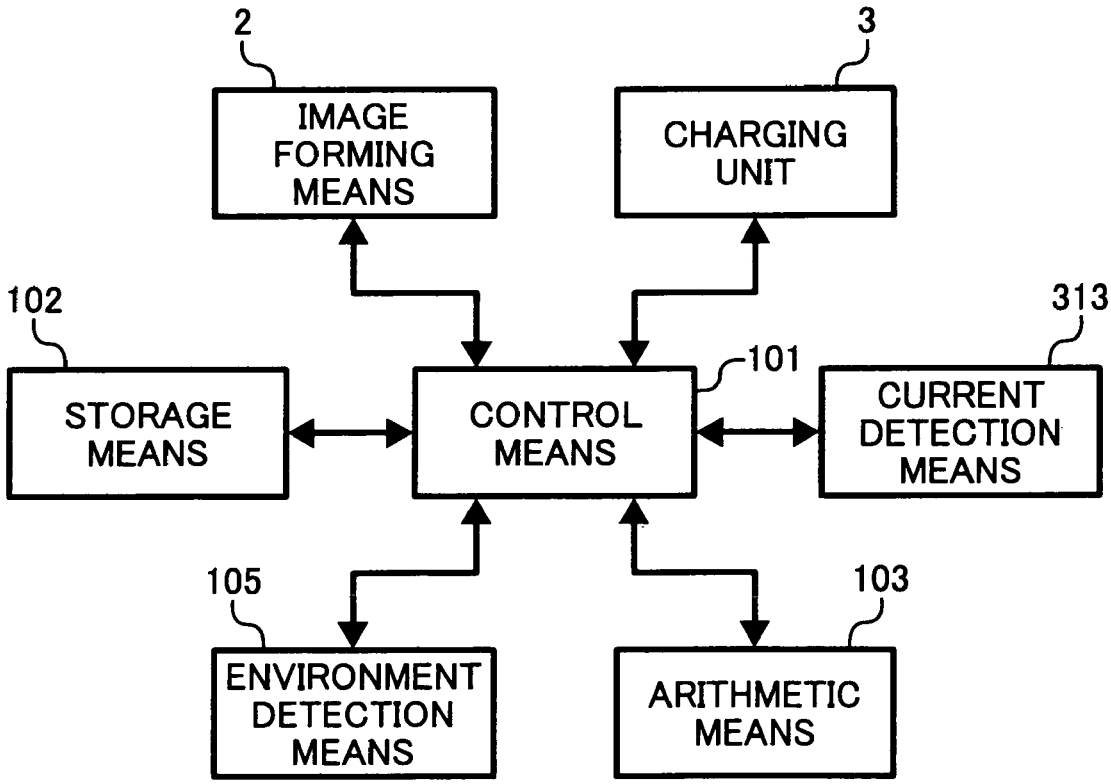
FIG. 10 is a block diagram illustrating the configuration of the voltage detection means according to one embodiment of the invention.

FIG. 10 is a block diagram illustrating the configuration of the voltage detection means.

Referring to FIG. 10, the voltage determination means includes a control means 101, a memory means 102, an arithmetic means 103, and a current detection means 313.

The voltage determination means may also include an environment detection means 105.

Voltage values (Vpp 1, Vpp 2) and standard current value (A) are stored beforehand in the memory means 102. In addition, the memory means 102 is configured to memorize also the detection current (Ivpp) detected with the current detection means 313 and the standard voltage value (Vpp_aim) obtained with the arithmetic means 103.

The arithmetic means 103 is configured to obtain the relational expression of the AC voltage versus AC current in the range of 2×Vth or larger, and to obtain the standard voltage value Vpp_aim from the relational expression noted just above and the standard AC current value A.

The control means 101 is configured to the voltage value applied to the charging roller 3*a* of the charging unit 3. The control means 101 is also configured to control the number of revolutions of the photoreceptor 1 included in respective image forming means 2 (2Y, 2M, 2C, 2K).

A setup of the AC voltage is scheduled to be carried out, for example, prior to the aforementioned pro-con action, at the time of the recovery from paper jam or of appreciable environmental change.

In order to control image density with high precision in the pro-con action, it is necessary for the surface potential of the photoreceptor 1 to be kept uniform.

Image density control with high precision becomes feasible, therefore, by adjusting the AC voltage to be equal to the standard voltage (Vpp_aim) so that the surface potential of the photoreceptor 1 is brought to be uniform, whereby excellent image quality can be achieved.

In the case when a paper jam takes place, toner images which have not been transferred onto copysheets may remain as they are on the photoreceptor 1 as un-transferred toner particles.

As a result, such an amount of as large as exceeding the maximum toner removal capability of the cleaning unit 7 of un-transferred toner is displaced to the cleaning unit 7, and the portions un-removed by the cleaning unit 7 out of the thus un-transferred toner are brought to the region where the charging roller 3*a* and the photoreceptor 1 face with each other.

In such a case, some of the un-transferred toner may adhere to the charging roller 3*a*, the resistance of the roller portion adhered with the toner increases, the electrical discharge is halted around the adhered portion, and, as a result, there may give rise to a difficulty of failing the uniform charging over the surface of the photoreceptor 1.

This difficulty can be obviated by properly adjusting the standard voltage (Vpp_aim) at the time of the recovery from paper jam.

That is, the amount of charge can be brought to such a value that the surface of the photoreceptor 1 is uniformly charged by properly adjusting Vpp_aim even in the presence of the un-transferred toner adhered to the charging roller 3*a*. As a result, the difficulty can be avoided in printing out images degraded by, for example, uneven image density at the time of the paper jam recovery.

The setup of the AC voltage may alternatively be performed by providing in the vicinity of the charging roller 3*a* a temperature-humidity sensor as an environment sensor means 105 for detecting temperature or humidity and by carrying out the setting of the AC voltage based on the result obtained from the detection with the environment sensor means 105.

Several changes take place by the change in environmental conditions such as, for example, the gap between the charging roller 3*a* and the photoreceptor 1 becomes narrow under the conditions of high temperature and humidity and the resistance of the charging roller 3*a* decreases by moisture absorption.

As a result, even for the value of the standard voltage value Vpp_aim at which the desirable charging is achieved under the normal temperature and humidity conditions, a difficulty may arise under the high temperature and humidity conditions, in which the discharge to the photoreceptor 1 increases and the life of the photoreceptor 1 thereby decreases.

Under low temperature and humidity conditions, by contrast, the charging roller 3*a* becomes dry and the resistance thereof increases.

As a result, even for the value of the standard voltage value Vpp_aim at which the desirable charging is achieved under the normal temperature and humidity conditions, another difficulty may arise under the low temperature and humidity conditions, in which the discharge to the photoreceptor 1 is halted and the surface thereof cannot be charged uniformly.

In the case when any appreciable change in environmental condition is detected, therefore, by suitably changing the standard voltage (Vpp_aim) in response to the result obtained from the detection with the environment sensor means 105, the amount of discharge to the photoreceptor 1 is kept normal, and the life of the photoreceptor 1 can be extended.

In addition, detection means for measuring the distance covered by the charging roller 3*a* may further be provided.

In the case when the distance covered by the charging roller 3*a* is measured by the detection means exceeding a predetermined value, the setting of the AC voltage may be altered accordingly.

Examples of the means include ones for detecting the distance based on the number of revolutions of the charging roller 3*a*, the accumulative total of copied sheets, and/or the number of revolutions of the photoreceptor 1.

By setting, therefore, the reference voltage value (Vpp_aim) whenever the covered distance of the charging roller 3*a* exceeds a predetermined value, the amount of discharge to the photoreceptor 1 can be maintained at the proper value even if its resistance has changed by, for example, dirty surface of the charging roller 3*a* by the use over time.

In addition to the above-noted timing, by the setting the AC voltage alternatively at the time of power supply on, it becomes unnecessary to store the values of the standard voltage (Vpp_aim) and the covered distance of charging roller 3*a* to the nonvolatile memory, whereby corresponding costs can be reduced.

Still in addition, the setting of the AC voltage may alternatively be carried out at the time of maintenance manually by a service person.

For carrying out the manual AC voltage setting, a voltage setting instruction is provided for instructing the printer 110 to perform a setting of the standard voltage (Vpp_aim), and the setting thereof is performed according to the instruction issued by the voltage setting instruction means.

The voltage setting instruction means may be formed of an operation console as a display means and the control means 101 mentioned earlier.

On inputting a password through the operation console of the printer 110 the control means 101 instructs to perform the setting of the standard voltage (Vpp_aim) after authenticating the password.

In the next place, the flow of process steps for setting the AC voltage will be described.

Figure 11:
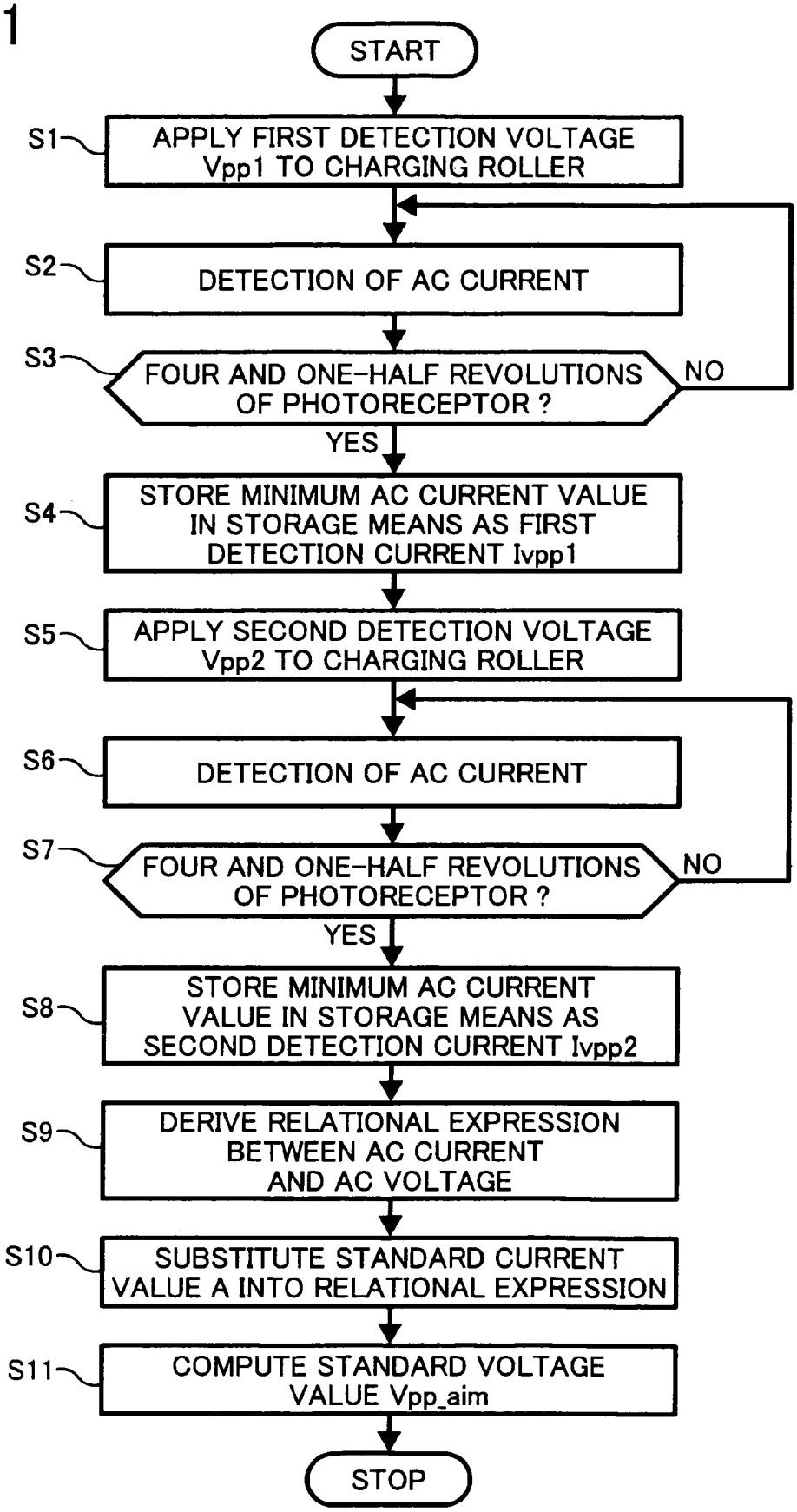
FIG. 11 is a flowchart illustrating an operation of setting and determining the AC voltage according to one embodiment of the invention.

FIG. 11 is a flowchart illustrating an operation of setting and determining the AC voltage in the present invention.

On arriving at the predetermined timing of at least one of turning on the power supply, recovering from paper jam, and initiating the pro-con action, the process steps are initiated according to the flowchart.

Referring now to FIG. 11, the control means 101 is configured to rotate the photoreceptor 1 by driving a driving unit including a motor, and simultaneously instruct AC output circuit 311 to apply a first detection voltage Vpp 1 to the charging roller 3*a* (Step S1).

On applying the first detection voltage Vpp 1 to the charging roller 3*a*, AC current detection means 313 is adapted to detect an AC current flowing into the photoreceptor 1 under the applied voltage, and the detected value of the AC current is output to the control means 101 (Step S2).

Based on the current value outputted from the AC current detection means 313, the control means 101 is adapted to measure current values for four and one-half revolutions of the photoreceptor 1 and to obtain the minimum current value among the measured current values. Thereafter, the minimum current value detected as above is stored in the storage means 102 as a first detection current Ivpp 1 (Steps S3 and S4).

Subsequently, the control means 101 instructs the AC output circuit 311 to apply a second detection voltage Vpp 2 to the charging roller 3*a* (Step S5).

On applying the second detection voltage Vpp 2 to the charging roller 3*a*, AC current detection means 313 is adapted to detect an AC current flowing into the photoreceptor 1, and the detected value of the AC current is output to the control means 101 (Step S6).

The control means 101 makes the measurement of the minimum current value for four and one-half revolutions of the photoreceptor 1 based on the current value outputted from the AC current detection means 313, and the detected minimum current value is stored in the storage means 102 as a second detection current Ivpp 2 (Steps S7 and S8).

Although the interval of measuring AC current flowing into the photoreceptor 1 is taken as four and one-half revolutions of the photoreceptor 1 in the above example, it is preferred for the interval to be taken as the number of revolutions of the photoreceptor 1 corresponding to the least common multiple of the number of teeth of the gears included in the driving unit.

This number of revolutions is selected for the reason that the fluctuation of the gap between the charging roller 3*a* and the photoreceptor 1, which is resulted from the rattle and decentering of the gear, may affect the proper determination of the minimum current value. In order to obviate the effect, the current value is preferably measured over the possible combination of the gears involved, in which the number of revolutions of the photoreceptor 1 is taken to be the least common multiple of the combination of the gears included in the driving unit as mentioned above, whereby the minimum current value can be detected properly.

By contrast, in the case when the charging roller 3*a* is designed not to bring the photoreceptor 1 to rotate therewith but both rotate individually, it is preferable that the number of revolutions of the photoreceptor 1 is taken to be the least common multiple of (1) the first combination of the gears included in the first driving unit for driving the charging roller 3*a*, and (2) the second combination of the gears included in the second driving unit for the photoreceptor 1.

As mentioned earlier, the minimum current value is obtained among the detection currents Ivpp measured by the AC current detection means 313, the reasons for which is as follows.

Since the photoreceptor 1 and the charging roller 3*a* are both rotating during the current detection, the gap is changing every instant.

When the gap between the charging roller 3*a* and the photoreceptor 1 is relatively large, the amount of electric discharge decreases and the value of detected current also decreases.

On the other hand, when the gap is relatively small, the amount of electric discharge increases and the detected current value also increases.

By taking the minimum current value as the detection current, therefore, the amount of discharge to the photoreceptor 1 can be maintained at the proper value and the surface of the photoreceptor 1 is uniformly charged even for the maximum gap between the charging roller 3*a* and the photoreceptor 1.

In the next place, the control means 101 instructs the arithmetic means 103 to derive the relational expression of the AC current versus AC voltage (peak-to-peak voltage) based on the first detection voltage Vpp 1 and the first detection current Ipp 1, and the second detection voltage Vpp 2 and the second detection current Ipp 2, which are each stored in the memory means 102 (Step S9).

Thereafter, the standard AC current value A is substituted into the relational expression derived as above (Step S10), the standard voltage value Vpp_aim is computed, and the resulting standard voltage value Vpp_aim is stored in the memory means 102 through the control means 101, whereby the standard voltage value Vpp_aim is updated (Step S11).

It may be noted in this context that the standard AC current value A is set slightly lager than the current value Ivth which corresponds to the AC voltage 2×Vth applied to the charging roller 3*a*, the reasons for which are as follows.

The AC current value detected with the current detection means 313 is considered as an average of the amount of electric discharge in the longitudinal direction of the charging roller 3*a*.

Assuming that there is unevenness such as pits and projections in the axial direction on the surface of the charging roller 3*a* and the photoreceptor, an actual discharge value differs from the AC current value detected with the current detection means 313.

For example, a discharge value becomes smaller than the average AC current value at the location where a pit in the axial direction on the charging roller 3*a* happens to face another pit on the photoreceptor.

As a result, when the standard AC current value is taken to be equal to the current value which corresponds to the AC voltage 2×Vth applied to the charging roller 3*a*, the discharge may not takes place at the location where the pit portions come to face with each other for the charging roller 3*a* and the photoreceptor, whereby a difficulty arises in failing to retain the uniform charging to a predetermined voltage at the location.

By setting the standard AC current value, therefore, to be slightly lager than the current value corresponding to the AC voltage 2×Vth applied to the charging roller 3*a*, a sufficient amount of discharge can be obtained even at the location where the gap between the charging roller 3*a* and the photoreceptor 1 is relatively large, whereby the surface of the photoreceptor 1 can be charged uniformly.

Next, a description will be made on the voltage setting means in the present embodiment.

The control means 101 as one of the constituents of the voltage setting means, is configured to update the AC voltage value in the memory means 102 by (1) actually applying the standard voltage Vpp_aim, which is determined and stored in the memory means 102 as mentioned earlier, to the charging roller 3*a*, (2) making a measurement on an AC current Ivpp 3 flowing into the photoreceptor 1 under the voltage Vpp_aim, (3) deciding whether the AC current Ivpp 3 is within a predetermined range B with respect to the standard AC current value A, (4) if the AC current Ivpp 3 is within the predetermined range B, setting the standard voltage Vpp_aim as the AC voltage to be applied to the charging roller 3*a*, and (5) updating the AC voltage by storing the AC voltage set as above in the memory means 102.

It is possible, in principle, to compute an current value as the standard current value A through the relational expression noted above with the AC voltages (Vpp 1, Vpp 2) and the AC currents (Ivpp 1, Ivpp 2). However, the current value as the standard current value A computed in this manner is generally suffered from scattering caused by the voltages (Vpp 1, Vpp 2) and currents (Ivpp 1, Ivpp 2), and a concomitant decrease may result in the accuracy of the current value.

In order to improve the accuracy of the current value, therefore, the control means 101 instructs the AC output circuit 311 to actually apply the standard voltage Vpp_aim, which is determined and stored in the memory means 102, to the charging roller 3*a*.

When the standard voltage Vpp_aim is applied to the charging roller 3*a*, AC current detection means 313 detects the AC current flowing into the photoreceptor 1 and the detected value of the AC current is output to the control means 101.

The control means 101 is adapted to check the current value Ivpp 3 detected as above by the AC current detection means 313; if the AC current Ivpp 3 is within a predetermined range B with respect to the standard AC current value A, set the standard voltage Vpp_aim corresponding to the current value 1 vpp3; and instruct to store the standard voltage Vpp_aim set as above in the memory means 102, whereby the desirable amount of discharge can be obtained sufficient for uniformly charging the surface of the photoreceptor 1.

As a result, the time, required for determining the AC voltage value applied to the charging means, can be reduced; the setting of the AC current can be achieved with high accuracy; and the photoreceptor 1 can be brought to desirable charging potential by preventing the degradation caused by discharge.

The predetermined range B for the AC current Ivpp is preferably in the range from ±1%, to ±10% of the standard AC current value A. That is, by the term, the value B corresponding to ±1% range of AC current value A, is meant that the appropriate value B is in the range from A×99% to A×101%.

For the Ivpp 3 of A±1% or less, the possibility for the Ivpp 3 to be found there within is quite small, hence this range setting is of no practical use. For the Ivpp 3 of A±10% or larger, by contrast, the accuracy of AC voltage setting decreases, whereby difficulties arise such as image disorder and filming during copying, for example.

The following embodiments are provided to further detail the present invention.

Embodiment 2

In the AC voltage setting method in the embodiment indicated above, there arises a difficulty in setting AC voltage with sufficient accuracy in the case when the AC current Ivpp 3 is not found within a predetermined range B with respect to the standard AC current value A.

In order to obviate this difficulty, the setting method in the second embodiment is carried out in a manner similar to the first embodiment with the exception that the control means 101 instructs the arithmetic means 103 to compute a fourth AC voltage value Vpp 4 such that the AC voltage (i.e., Vpp 4) to be applied to the charging roller 3*a* yields the standard current value A, using the abovementioned relational expression of the AC current versus AC voltage, the AC voltages (Vpp 1, Vpp 2), the AC currents (Ivpp 1, Ivpp 2), and Vpp 3 and Ivpp 3.

In other words, the arithmetic means 103 computes a fourth AC voltage value such that the gradient of the straight line crossing the points (Vpp 3 and Ivpp 3) and (Vpp 4 and standard current value A) is brought to be equal to the gradient of the abovementioned relational expression of the AC current versus AC voltage.

Subsequently, the value Vpp 4 obtained as above is set as the AC voltage to be applied to the charging roller 3*a* and the AC voltage is updated by storing this AC voltage in the memory means 102.

As a result, the setting of the AC voltage can be performed with high precision.

Embodiment 3

The setting method in the third embodiment is carried out in a manner similar to the second embodiment with the exception that the control means 101 instructs the AC output circuit 311 to (1) actually apply the standard voltage Vpp_aim stored in the memory means 102 to the charging roller 3*a*, (2) make a measurement on an AC current Ivpp 3 (which is hereinafter referred to as Ivpp (n)) flowing into the photoreceptor 1, and (3) decide whether the AC current Ivpp (n) is within a predetermined range B with respect to the standard AC current value A.

Subsequently, the control means 101 instructs the arithmetic means 103, if the AC current Ivpp (n) is not within the predetermined range B, to perform repeatedly the following two process steps of (4) computing fourth AC voltage values Vpp 4 repeatedly until the AC current Ivpp (n) falls within the predetermined range B such that the AC voltage Vpp 4 yields the standard current value A, using the abovementioned relational expression of the AC current versus AC voltage, the AC voltages (Vpp 1, Vpp 2), the AC currents (Ivpp 1, Ivpp 2), and Vpp 3 and Ivpp 3, and updating the AC voltage by storing the AC voltage computed as above in the memory means 102, and (5) deciding whether the AC current Ivpp (n) which is lately obtained is found within the predetermined range B with respect to the standard AC current value A.

If the AC current Ivpp (n) is found within the predetermined range B, the control means 101 is adapted to set the presently applied value Vpp (n) as the AC voltage to be applied to the charging roller 3*a* and the AC voltage is updated by storing this AC voltage Vpp (n) in the memory means 102, whereby the setting of the AC voltage can be achieved with high precision.

Embodiment 4

The setting method in the fourth embodiment is carried out in a manner similar to the third embodiment with the exception that an upper limit D is provided regarding the number C of repetitions for computing the AC current Ivpp (n) such that the process steps for the computation are terminated when the number C exceeds the upper limit D.

This offers an advantage of obviating endless repetitions of the computation process steps.

Although the length of the upper limit D cannot be uniquely specified because of variable length of one cycle of the process steps, it is desirable in practice for the upper limit D be determined so as to yield a time length ranging from 5 to 20 seconds in total for the process.

Embodiment 5

In the process steps for computing the voltage values according to the fourth embodiment, there may give rise to the case where the AC current Ivpp (n) does not come into the predetermined range B even after the process steps are repeated up to the upper limit D.

One of the reasons for the abovementioned repeated process steps may be considered due to failure in charging the photoreceptor 1, for example. The photoreceptor 1 is considered in this case to be suffered from considerably dirty background (which is close to the formation of full-page solid images) with the possibility of consuming a large amount of toner.

In the present embodiment, therefore, the setting method is carried out in a manner similar to the fourth embodiment with the exception that, in the case when the number of repetitions exceeded the upper limit D, the control means 101 is configured to instruct (1) the AC output circuit 311 and the DC output circuit 312 to turn off the charging unit 3 promptly by discontinuing the voltage application to the charging roller 3*a*, and (2) the display unit on the operation panel to activate a flashing signal notifying the trouble with the charging unit 3.

With this configuration of the setting method, the malfunctioning of the system of, for example, wasting a large amount of toner can be obviated.

Embodiment 6

As another reason for the abovementioned repeated process steps may be considered due to a count error by an external cause such as a noise, for example.

In this case, although there is no need of turning off the charging unit 3, the setting value of the AC voltage cannot be determined.

In the present embodiment, therefore, the setting method is carried out in a manner similar to the fourth embodiment with the exception that, in the case when the number of repetitions exceeded the upper limit D, the control means 101 is configured, in reference to the preceding AC voltage value stored in the memory means 102, to instruct the AC output circuit 311 to apply this preceding AC voltage to the charging roller 3*a*.

As a result, it becomes feasible to operate the charging unit 3 without interruption.

It is apparent from the above description including the examples disclosed that the voltage control method, charging unit and several apparatuses incorporating the charging unit of the invention have various advantages over similar units and apparatuses previously known.

According to the voltage control method of the present embodiments, for example, when the third AC voltage Vpp 3 is actually applied to the photoreceptor 1 as the charge receptor member with the charging roller 3*a* as the charging member, and when the third AC current Ivpp 3, which flows into the charge receptor member under the third AC voltage Vpp 3, is within a predetermined range B with respect to the standard AC current value A, the third AC voltage Vpp 3 is set as the AC voltage to be applied to the charging roller 3*a*.

As a result, the period of time required for the setting is reduced, the setting of the AC voltage can be performed with high precision, and the photoreceptor 1 can be brought to desirable charging potential by preventing the degradation caused by discharge.

According to the voltage control method of the second embodiment, in the case when the AC current Ivpp 3 is not found within the predetermined range B with respect to the standard AC current value A, a fourth AC voltage Vpp 4 is computed such that the AC voltage Vpp 4 yields the standard current value A, using the gradient of the relational expression, the third AC voltage Vpp 3, and the third AC current Ivpp 3, and subsequently set as the AC voltage to be applied to the charging member.

The setting of the AC voltage can therefore be achieved with high precision.

As described earlier in the third embodiment, when the computed AC voltage Vpp 4 computed previously is applied to the charging roller 3*a* as an n-th AC voltage Vpp (n), and when the AC current Ivpp (n) flowing into the photoreceptor under the n-th AC voltage Vpp (n) is not within a predetermined range B with respect to the standard AC current value A, the AC voltage value Vpp (n) is computed repeatedly until the AC current Ivpp (n) falls within the predetermined range B such that the AC voltage Vpp (n) yields the standard current value A.

Subsequently, when the AC current Ivpp (n) falls within the predetermined range B, the n-th AC voltage value Vpp (n) is set as the AC voltage to be applied to the charging roller 3*a*.

The setting of the AC voltage can therefore be achieved with high precision.

The charging unit disclosed herein is therefore capable of attaining stable charging of the charge receptor member over a long period of time by adopting the voltage control method of the present invention.

The thus formed charging unit is suitably incorporated into the image forming apparatus in the invention, individually or in combination as the process cartridge, whereby excellent and durable image qualities are attained in copy images.

Since the image forming apparatus is constructed incorporating the charging unit of the invention, it becomes possible to obtain copy images stabilized for a long period of time.

Still in addition, since the process cartridge is formed by integrally including the image bearing member and the charging unit of the invention, the process cartridge can offer the capability of forming copy images stabilized for a long period of time.

Moreover, the image forming apparatus may alternatively be constructed incorporating the process cartridge of the invention. This image forming apparatus is therefore capable of forming copy images stabilized over a long period of time.

The process steps set forth in the present description on controlling voltages of the charging member for charging uniformly the surface of the photoreceptor may be implemented using conventional general purpose microprocessors, programmed according to the teachings in the present specification, as will be appreciated to those skilled in the relevant arts. Appropriate software coding can readily be prepared by skilled programmers based on the teachings of the present disclosure, as will also be apparent to those skilled in the relevant arts.

The present specification thus include also a computer-based product which may be hosted on a storage medium, and include instructions which can be used to program a microprocessor to perform a process in accordance with the present disclosure. This storage medium can include, but not limited to, any type of disc including floppy discs, optical discs, CD-ROMs, magneto-optical discs, ROMs, RAMs, EPROMs, EEPROMs, flash memory, magnetic or optical cards, or any type of media suitable for storing electronic instructions.

While the invention has been described in connection with the preferred embodiment, it will be understood that it is not intended to limit the invention to the embodiment. On the contrary, it is intended to cover such modifications or variations as may come within the scope of the following claims.

The invention claimed is:

1. A method for controlling a voltage of a charging member for charging uniformly a surface of a charge receptor member by applying a DC voltage superposed with an AC voltage, said method comprising:

measuring a discharge onset voltage Vth for initiating a discharge to said charge receptor member by applying the DC voltage to said charging member;

measuring a first detection current flowing into said charge receptor member when a first AC voltage of 2×Vth or larger is applied solely to said charging member;

measuring a second detection current flowing into said charge receptor member when a second AC voltage is applied to said charging member, the second AC voltage being 2×Vth or larger and different from the first AC voltage;

determining a relational expression between the AC voltage to be applied to said charging member and an AC current flowing into said charge receptor member in a range of 2×Vth or larger, based on the first and second AC voltages and on the measured first and second detection currents; and obtaining a third AC voltage to be applied to said charging member by substituting a predetermined standard AC current value into the determined relational expression, said predetermined standard AC current value being sufficient to uniformly charge said charge receptor member, wherein, when a third AC current, which flows into said charge receptor member under the third AC voltage actually applied to said charging member, is within a predetermined range with respect to the predetermined standard AC current value, the obtaining step includes setting the third AC voltage as the AC voltage to be applied to said charging member.

2. The method according to claim 1, further comprising:

when the third AC current is not within said predetermined range with respect to the predetermined standard AC current value, calculating a fourth AC voltage such that the fourth AC voltage yields the predetermined standard AC current value, using a gradient of the determined relational expression, the third AC voltage, and the third AC current; and subsequently setting the fourth AC voltage as the AC voltage to be applied to said charging member.

3. The method according to claim 2, wherein, when the calculated fourth AC voltage is applied to said charging member as an n-th AC voltage, and when an n-th AC current, which flows into said charge receptor member under the n-th AC voltage applied to said charging member, is not within the predetermined range with respect to the predetermined standard AC current value, the n-th AC voltage value is calculated repeatedly until the n-th AC current falls within the predetermined range such that the n-th AC voltage yields the predetermined standard AC current value, and, when the n-th AC current falls within the predetermined range with respect to the predetermined standard AC current value, the n-th AC voltage value is set as the AC voltage to be applied to said charging member.

4. A charging unit for charging a surface of a charge receptor member by applying a DC voltage superposed with an AC voltage with a charging member, said charging member provided opposing to a charge receptor member, said charging unit comprising:

an AC current detection unit configured to detect a current flowing into said charge receptor member;

a voltage determination unit configured to measure a discharge onset voltage Vth for initiating a discharge to said charge receptor member by applying the DC voltage to said charging member;

to measure a first detection current flowing into said charge receptor member when a first AC voltage of 2×Vth or larger is applied solely to said charging member;

to measure a second detection current flowing into said charge receptor member when a second AC voltage is applied to said charging member, the second AC voltage being 2×Vth or larger and different from the first AC voltage;

to determine a relational expression between the AC voltage to be applied to said charging member and the AC current flowing into said charge receptor member in a range of 2×Vth or larger, based on the first and second AC voltages and on the measured first and second detection currents; and to obtain a third AC voltage to be applied to said charging member by substituting a predetermined standard AC current value into the relational expression, said predetermined standard AC current value being sufficient to uniformly charge said charge receptor member; and a voltage setting unit configured, when the third AC current, which flows into said charge receptor member under the third AC voltage actually applied to said charging member, is within a predetermined range with respect to the predetermined standard AC current value, to set the third AC voltage as the AC voltage to be applied to said charging member.

5. The charging unit according to claim 4, wherein said voltage setting unit is configured, when the third AC current is not within said predetermined range with respect to the predetermined standard AC current value, to calculate a fourth AC voltage such that the fourth AC voltage yields the predetermined standard current value, using a gradient of the determined relational expression, the third AC voltage, and the third AC current, and to set the fourth AC voltage as the AC voltage to be applied to said charging member.

6. The charging unit according to claim 5, wherein said voltage setting unit is configured, when the calculated fourth AC voltage is applied to said charging member as an n-th AC voltage, and when an n-th AC current, which flows into said charge receptor member under the n-th AC voltage applied to said charging member, is not within the predetermined range with respect to the predetermined standard AC current value, to calculate the n-th AC voltage value repeatedly n times until the n-th AC current falls within the predetermined range such that the n-th AC voltage yields the predetermined standard current value, and, when the n-th AC current falls within the predetermined range with respect to the predetermined standard AC current value, and to set the n-th AC voltage value as the AC voltage to be applied to said charging member.

7. The charging unit according to claim 6, wherein said voltage setting unit is configured to calculate the n-th AC voltage value based on an upper limit regarding a number of repetitions for calculating the n-th AC voltage.

8. The charging unit according to claim 7, wherein, when the number of repetitions exceeds the upper limit, said charging unit is configured to be turned off.

9. The charging unit according to claim 7, wherein, when the number of repetitions exceeds the upper limit, the n-th AC voltage, which is used for setting the preceding AC voltage, is applied to said charging member.

10. An image forming apparatus, comprising:

an image bearing member; and a charging unit configured to charge said image bearing member;

said charging unit comprising an AC current detection means for detecting a current flowing into a charge receptor means;

a voltage determination means for measuring a discharge onset voltage Vth for initiating a discharge to said charge receptor means by applying the DC voltage to a charging means;

for measuring a first detection current flowing into said charge receptor means when a first AC voltage of 2×Vth or larger is applied solely to said charging means;

for measuring a second detection current flowing into said charge receptor means when a second AC voltage is applied to said charging means, the second AC voltage being 2×Vth or larger and different from the first AC voltage;

for determining a relational expression between the AC voltage to be applied to said charging means and the AC current flowing into said charge receptor means in the range of 2×Vth or larger, based on the first and second AC voltages and on the first and second detection currents; and for obtaining a third AC voltage to be applied to said charging means by substituting a predetermined standard AC current value into the determined relational expression, said predetermined standard AC current value being sufficient to uniformly charge said charge receptor means; and a voltage setting means, when a third AC current, which flows into said charge receptor means under the third AC voltage actually applied to said charging means, is within a predetermined range with respect to the predetermined standard AC current value, for setting the third AC voltage as the AC voltage to be applied to said charging means;

when the third AC current is not within said predetermined range with respect to the predetermined standard AC current value, for calculating a fourth AC voltage such that the fourth AC voltage yields the predetermined standard current value, using the gradient of the determined relational expression, the third AC voltage, and the third AC current and for setting the fourth AC voltage as the AC voltage to be applied to said charging means; and when the calculated fourth AC voltage is applied to said charging means as an n-th AC voltage, and when an n-th AC current, which flows into said charge receptor means under the n-th AC voltage applied to said charging means, is not within the predetermined range, with respect to the predetermined standard AC current value, for calculating the n-th AC voltage value repeatedly n times until the n-th AC current falls within the predetermined range, such that the n-th AC voltage yields the predetermined standard current value, and, when the n-th AC current falls within the predetermined range with respect to the predetermined standard AC current value, for setting the n-th AC voltage value as the AC voltage to be applied to said charging means.

11. A process cartridge provided detachably from a main chassis of an image forming apparatus, said process cartridge including an image bearing member and a charging unit configured to charge said image bearing member, said charging unit comprising:

an AC current detection means for detecting a current flowing into a charge receptor means;

a voltage determination means for measuring a discharge onset voltage Vth for initiating a discharge to said charge receptor means by applying the DC voltage to a charging means;

for measuring a first detection current flowing into said charge receptor means when a first AC voltage of 2×Vth or larger is applied solely to said charging means;

for measuring a second detection current flowing into said charge receptor means when a second AC voltage is applied to said charging means, the second AC voltage being 2×Vth or larger and different from the first AC voltage;

for determining a relational expression between the AC voltage to be applied to said charging means and the AC current flowing into said charge receptor means in a range of 2×Vth or larger, based on the first and second AC voltages and on the measured first and second detection currents; and for obtaining a third AC voltage to be applied to said charging means by substituting a predetermined standard AC current value, into the determined relational expression, said predetermined standard AC current value being assumed in advance suffice for uniformly charging said charge receptor means; and a voltage setting means, when a third AC current, which flows into said charge receptor means under the third AC voltage actually applied to said charging means, is within a predetermined range with respect to the predetermined standard AC current value, for setting the third AC voltage as the AC voltage to be applied to said charging means;

when the third AC current is not within said predetermined range with respect to the predetermined standard AC current value, for calculating a fourth AC voltage such that the fourth AC voltage yields the predetermined standard current value, using the gradient of the determined relational expression, the third AC voltage, and the third AC current, and setting the fourth AC voltage as the AC voltage to be applied to said charging means; and when the calculated fourth AC voltage is applied to said charging means as an n-th AC voltage, and when an n-th AC current, which flows into said charge receptor means under the n-th AC voltage applied to said charging means, is not within the predetermined range with respect to the predetermined standard AC current value, for calculating the n-th AC voltage value repeatedly n times until the n-th AC current falls within the predetermined range such that the n-th AC voltage yields the predetermined standard current value, and, when the n-th AC current falls within the predetermined range with respect to the predetermined standard AC current value, for setting the n-th AC voltage value as the AC voltage to be applied to said charging means.

12. An image forming apparatus, comprising:

a process cartridge provided detachably from a main chassis of said image forming apparatus, said process cartridge integrally including an image bearing member; and a charging unit configured to charge said image bearing member, said charging unit including an AC current detection means for detecting a current flowing into a charge receptor means;

a voltage determination means for measuring a discharge onset voltage Vth for initiating a discharge to said charge receptor means by applying a DC voltage to a charging means;

for measuring a first detection current flowing into charge receptor means when a first AC voltage of 2×Vth or larger is applied solely to said charging means;

for measuring a second detection current flowing into said charge receptor means when a second AC voltage is applied to said charging means, the second AC voltage being 2×Vth or larger and different from the first AC voltage;

for determining a relational expression between the AC voltage to be applied to said charging means and the AC current flowing into said charge receptor means in a range of 2×Vth or larger, based on the first and second AC voltages, and on the measured first and second detection currents; and for obtaining a third AC voltage to be applied to said charging means by substituting a predetermined standard AC current value into the determined relational expression, said predetermined standard AC current value being sufficient to uniformly charge said charge receptor means; and a voltage setting means, when a third AC current, which flows into said charge receptor means under the third AC voltage actually applied to said charging means, is within a predetermined range with respect to the predetermined standard AC current value, for setting the third AC voltage as the AC voltage to be applied to said charging means;

when the third AC current is not within said predetermined range with respect to the predetermined standard AC current value, for calculating a fourth AC voltage such that the fourth AC voltage yields the predetermined standard current value, using the gradient of the determined relational expression, the third AC voltage, and the third AC current and setting the fourth AC voltage as the AC voltage to be applied to said charging means; and when the calculated fourth AC voltage is applied to said charging means as an n-th AC voltage and when an n-th AC current, which flows into said charge receptor means under the n-th AC voltage applied to said charging means, is not within the predetermined range with respect to the predetermined standard AC current value, for computing the n-th AC voltage value repeatedly n times until the n-th AC current falls within the predetermined range such that the n-th AC voltage yields the predetermined standard current value, and, when the n-th AC current falls within the predetermined range with respect to the predetermined standard AC current value, for setting the n-th AC voltage value as the AC voltage to be applied to said charging means.

13. A charging unit configured to charge a surface of a charge receptor means by applying a DC voltage superposed with an AC voltage with a charging member, a charging means provided opposing to said charge receptor means, said charging unit comprising:

an AC current detection means for detecting a current flowing into said charge receptor means;

a voltage determination means for measuring a discharge onset voltage Vth for initiating a discharge to said charge receptor means by applying the DC voltage to said charging means;

for measuring a first detection current flowing into said charge receptor means when a first AC voltage of 2×Vth or larger is applied solely to said charging member;

for measuring a second detection current flowing into said charge receptor means when a second AC voltage is applied to said charging means, the second AC voltage being 2×Vth or larger and different from the first AC voltage;

for determining a relational expression between the AC voltage to be applied to said charging means and the AC current flowing into said charge receptor means in a range of 2×Vth or larger, based on the measured first and second AC voltages and on the first and second detection currents; and for obtaining a third AC voltage to be applied to said charging means by substituting a predetermined standard AC current value into the determined relational expression, said predetermined standard AC current value being sufficient to uniformly charge said charge receptor means; and a voltage setting means, when a third AC current, which flows into said charge receptor means under the third AC voltage actually applied to said charging means, is within a predetermined range with respect to the predetermined standard AC current value, for setting the third AC voltage as the AC voltage to be applied to said charging means.

14. The charging unit according to claim 13, wherein said voltage setting means, when the third AC current is not within said predetermined range with respect to the predetermined standard AC current value, calculates a fourth AC voltage such that the fourth AC voltage yields the predetermined standard current value, using the gradient of the determined relational expression, the third AC voltage, and the third AC current, and sets the fourth AC voltage as the AC voltage to be applied to said charging member.

15. The charging unit according to claim 14, wherein said voltage setting means, when the calculated fourth AC voltage is applied to said charging means as an n-th AC voltage, and when an n-th AC current, which flows into said charge receptor means under the n-th AC voltage applied to said charging means, is not within the predetermined range with respect to the predetermined standard AC current value, calculates the n-th AC voltage value repeatedly n times until the n-th AC current falls within the predetermined range such that the n-th AC voltage yields the predetermined standard current value, and, when the n-th AC current falls within the predetermined range with respect to the predetermined standard AC current value, and sets the n-th AC voltage value as the AC voltage to be applied to said charging means.

16. The charging unit according to claim 15, wherein said voltage setting means calculates the n-th AC voltage based on an upper limit regarding a number of repetitions for calculating the n-th AC voltage.

17. The charging unit according to claim 16, wherein, when the number of repetitions exceeds the upper limit, said charging unit is configured to be turned off.

18. The charging unit according to claim 16, wherein, when the number of repetitions exceeds the upper limit, the n-th AC voltage, which is used for setting the preceding AC voltage, is applied to said charging means.

* * * * *